US011471883B2

(12) United States Patent
Yamauchi et al.

(10) Patent No.: US 11,471,883 B2
(45) Date of Patent: Oct. 18, 2022

(54) FLUID CHIP, FLUID DEVICE, AND METHOD FOR MANUFACTURING SAME

(71) Applicant: Enplas Corporation, Kawaguchi (JP)

(72) Inventors: Takumi Yamauchi, Kawaguchi (JP); Nobuya Sunaga, Kawaguchi (JP)

(73) Assignee: Enplas Corporation, Kawaguchi (JP)

( * ) Notice: Subject to any disclaimer, the term of this patent is extended or adjusted under 35 U.S.C. 154(b) by 196 days.

(21) Appl. No.: 16/765,258

(22) PCT Filed: Nov. 9, 2018

(86) PCT No.: PCT/JP2018/041597

§ 371 (c)(1),
(2) Date: May 19, 2020

(87) PCT Pub. No.: WO2019/102865

PCT Pub. Date: May 31, 2019

(65) Prior Publication Data

US 2020/0306752 A1 Oct. 1, 2020

(30) Foreign Application Priority Data

Nov. 22, 2017 (JP) ..... JP2017-225201
Aug. 8, 2018 (JP) ..... JP2018-149346

(51) Int. Cl.
*B01L 3/00* (2006.01)

(52) U.S. Cl.
CPC . *B01L 3/502707* (2013.01); *B01L 2300/0809* (2013.01)

(58) Field of Classification Search
CPC ..... B01L 3/502707; B01L 3/502715; B01L 2400/0487; B01L 2300/0809;
(Continued)

(56) References Cited

U.S. PATENT DOCUMENTS 7,198,759 B2 4/2007 Bryning et al.
2006/0002817 A1 1/2006 Bohm et al.
(Continued)

FOREIGN PATENT DOCUMENTS

CN 1715929 1/2006
EP 1551554 7/2005
(Continued)

OTHER PUBLICATIONS

Dictionary.com Definition of "Penetrate", retrieved Jan. 2022 (Year: 2022).*

(Continued)

*Primary Examiner* — Benjamin R Whatley
*Assistant Examiner* — Jean Caraballo-Leon
(74) *Attorney, Agent, or Firm* — William C. Schrot; Jeffrey I. Auerbach; AuerbachSchrot LLC

(57) ABSTRACT

A fluid chip suitable for a fluid device is disclosed in which an upper surface of a flow passage has another member bonded thereto. The disclosed fluid chip, in which a flow passage is formed, comprises a base material having a top surface forming at least a portion of a bottom surface of a flow passage, and a bonding member which is formed from an elastomer resin and an upper end surface of which is provided in a position higher than the top surface of the base material. The base material has a support post portion which
(Continued)

projects from the top surface and defines the height of a side surface of the flow passage, and the support post portion of the base material is embedded in the bonding member.

20 Claims, 19 Drawing Sheets

(58) Field of Classification Search
CPC ..... B01L 2200/027; B01L 2400/0655; F04B 43/043; A61M 5/14276; A61M 2205/0244; B81C 3/001; B81C 2201/0181; B29C 65/54; B29C 66/1122; B29C 66/53461; B29C 66/542; B29C 65/48
See application file for complete search history.

(56) References Cited

U.S. PATENT DOCUMENTS

| | | | |
|---|---|---|---|
| 2007/0041878 | A1 | 2/2007 | Bryning et al. |
| 2014/0080226 | A1* | 3/2014 | Cauley, III ..... B01L 3/502715 436/180 |
| 2016/0281149 | A1 | 9/2016 | Hassibi et al. |
| 2018/0280974 | A1 | 10/2018 | Kazoe et al. |

FOREIGN PATENT DOCUMENTS

| | | | | |
|---|---|---|---|---|
| EP | 1612429 | | 1/2006 | |
| JP | 2005-111567 | | 4/2005 | |
| JP | 2005111567 | A * | 4/2005 | |
| JP | 2006-055837 | | 3/2006 | |
| JP | 2009-051004 | | 3/2009 | |
| JP | 2010-527022 | | 8/2010 | |
| JP | 2011-194379 | | 10/2011 | |
| JP | 2015-99070 | | 5/2015 | |
| JP | 2017-153422 | | 9/2017 | |
| KR | 10-2006-0049242 | | 5/2006 | |
| WO | 2004/011147 | | 2/2004 | |
| WO | WO-2017069256 | A1 * | 4/2017 | ..... B01L 3/502738 |

OTHER PUBLICATIONS

International Search Report PCT/JP2018/041597 (WO 2019/102865) (dated 2019) (2 pages).
Written Opinion of the International Searching Authority PCT/JP2018/041597 (WO 2019/102865) (dated 2019) (4 pages).

* cited by examiner

FLUID CHIP, FLUID DEVICE, AND METHOD FOR MANUFACTURING SAME

CROSS REFERENCE TO RELATED APPLICATIONS AND CLAIM TO PRIORITY

This Application is a national stage application of International Application No. PCT/JP2018/041597, filed Nov. 9, 2018, which claims priority to Japanese Application Nos. JP 2017-225201, filed Nov. 22, 2017, and JP-2018-149346, filed Aug. 8, 2018, which applications are herein incorporated by reference in their entireties and to which priority is claimed.

TECHNICAL FIELD

The present invention relates to a fluid chip in which a flow passage is formed, a fluid device using the fluid chip, and a method for manufacturing the same. It particularly relates to a microfluid chip having a structure suitable for bonding a bonded member to an upper surface of a microflow passage, a microfluid device using the microfluid chip, and a method for manufacturing the same.

BACKGROUND ART

In a microfluid device technique, a microfabrication technique such as MEMS (Microelectromechanical Systems) technique is used to make fluid-fed microamount spaces (hereinafter, also referred to as "microflow passage") such as a fine flow passage for transferring a fluid, a fine vessel for pooling and storing the fluid, and a fine reaction vessel for reacting the fluid, and the fluid is handled in the fine spaces. In the microfluid device, since a ratio of a surface area to a volume is high, a viscous force is more dominant than an inertial force. For example, a stream of a fluid in a fine flow passage is a laminar flow, and chemical and physical properties (concentration, pH, temperature, and the like) can be highly controlled, and therefore it is easy to operate and manage the conditions. In addition, there are advantages that a reaction through a surface can be efficiently caused, and furthermore an experiment can be performed with a small amount of fluid.

Such a microfluid device is used for measurement of microamount molecules, formation of an artificial membrane, measurement of cell function, or the like, particularly used for biochips in which a processing process and analysis/measurement functions related to living bodies are integrated. For example, Patent Document 1 discloses a biochip including a biochip layer and an image sensor layer on a single substrate, which detects a biochemical reaction, e.g. a biochemical between a reference sample and a target sample immobilized to a recessed portion formed on a biochip layer, representatively a complementary bond or an antigen-antibody reaction between DNA bases, on the image sensor layer by an optical process using fluorescence or luminescence. In addition, Patent Document 2 discloses a fluid device which has, on a way of a flow passage, a coarsely-crushing portion for coarsely crushing a biological tissue, a separation portion for separating a nucleic acid by crushing the coarsely crushed tissue, and a collection portion for collecting the separated nucleic acid, and makes it possible to separate the nucleic acid from blood cells, muscle tissues, or the like. Furthermore, Patent Document 3 discloses a biosensor array including an array in which a plurality of fine reaction chambers are formed, an optical sensor, and an optical filter such as a luminescent filter disposed between the reaction chambers and the optical sensor, and further discloses that the biosensor may be equipped with a temperature control element such as a heater and a temperature sensor. Patent Literature 4 discloses a microfluid device having a well which is a vessel-like small bath for containing a measurement solution, a cover member for sealing the well, a signal extraction opening portion having an exposed ion-sensitive portion provided in the well, and a field effect transistor type biosensor provided under the ion-sensitive portion.

As methods for manufacturing a microfluid chip in which the microflow passage is formed, a manufacturing method using a semiconductor manufacturing process, a manufacturing method by resin molding, a manufacturing method by film lamination, and the like have been proposed. Patent Document 1 discloses that an image sensor layer is formed on a silicon substrate by an image sensor manufacturing process including a photodetector forming process, then a transparent material such as $SiO_2$ is deposited on an upper portion of the image sensor layer, and then a plurality of recessed portions as reaction regions are formed in an etching step, so as to manufacture a biochip. In addition, Patent Document 2 discloses that: a molded body having a microflow passage is manufactured by molding a thermosetting resin with a replica mold, and the molded body is joined to a top plate in which a hole portion is formed at a position corresponding to the microflow passage so as to manufacture a fluid device; a photoresist is applied on one side of a glass base, a pattern is exposed and then developed with a developer to manufacture a substrate having a microflow passage and a projecting structure array, the top plate is heat-sealed to the substrate, and a reservoir is attached to inlet and outlet parts of the microflow passage with an adhesive, so as to manufacture a fluid device; and a plurality of bases in which the microflow passages are formed are bonded to each other by using a double-sided adhesive film so as to manufacture a fluid device having microflow passages. In addition, Patent Document 3 discloses that wells and a cover member covering the wells are bonded by heat sealing.

PRIOR ART DOCUMENTS

Patent Documents

Patent Document 1: Japanese Unexamined Patent Application No. 2010-527022

Patent Document 2: Japanese Patent Application Laid-Open No. 2017-153422

Patent Document 3: US Patent Application Publication No. 2016/281149, Specification Patent Document 4: Japanese Patent Application Laid-Open No. 2015-99070

SUMMARY OF INVENTION

Problem to be Solved

The microfluid device makes it possible to perform various experiments such as mixing, reaction, separation, culture, purification, and detection of a solution in a microflow passage. In recent years, a technique in which an image sensor and a biosensor are arranged adjacent to the microflow passage, and experimental results in the microflow passage are directly observed or measured as described in Patent Documents 1, 3, and 4 is expected. Furthermore, as a lab-on-a-chip in which a fluid control element (micropump, microvalve, micromixer, filter), a peripheral circuit (heating means, luminescent means), a detection system (various sensors), and the like are integrated, the microfluid device is intended to perform sample injection, pretreatment, stirring, mixing, reaction, isolation, purification, detection, and the like of a microamount of sample on one substrate, as described in Patent Document 2 as an example.

In Patent Document 1, as the method for manufacturing such a microfluid device, the image sensor layer is manufactured on the substrate using the semiconductor manufacturing process, on which the biochip layer is integrally manufactured, but due to the integral manufacture, the combination of the image sensor layer and the biochip layer is fixed. Furthermore, since a step of applying a resist on a substrate, a step of exposition, and a step of development are required, there is a problem of many manufacturing steps and there is still a room for improvement in manufacturing cost and productivity. In this regard, when the microfluid chip and the image sensor as the biochip layers are separately manufactured and then combined, the manufacturing cost and the productivity can be improved by individually mass-producing the microfluid chip and the image sensor. Additionally, by standardizing the microfluid chip, the microfluid chip can be joined with various members (fluid control element, peripheral circuit, detection system, and the like), and design flexibility can be relatively increased.

Patent Document 2 discloses that the reservoir is attached to the inlet and outlet parts of the microflow passage with the adhesive to manufacture the fluid device. A range of an allowable tolerance has been narrow by nature because a fine space should be handled for the microfluid device. However, particularly when quantifying, comparing, and evaluating a reaction or the like in a microflow passage, it was important to maintain an amount of a fine sample in the microflow passage at a constant level, and it was required to decrease ununiformness among microfluid devices. When bonding another member to the microfluid chip with an adhesive, it was difficult to adjust a width of the adhesive or a height of the bonded adhesive due to properties of the adhesive, resulting in ununiformness. Furthermore, when joining an image sensor or a biosensor to the microfluid chip with an adhesive, there was a likelihood that the adhesive protruded into the microflow passage, thereby an effective area of the sensor became narrow, and furthermore the protruding adhesive covered the sensor, and as a result, the sensor at the covered part could not effectively function.

In Patent Documents 2 and 4, heat sealing was used for manufacturing the microfluid device, but since bonding by heat sealing was normally carried out at a temperature equal to or higher than a glass transition point of the resin, there was a likelihood that the resin was deformed and ununiformness in the size of the microflow passage was caused. In particular, when microminiaturizing the microflow passage, influence of the deformation is great, and therefore it was difficult to enhance functionality of the microfluid chip by the heat seal method.

The present invention aims to provide a fluid chip having a novel structure different from before, a fluid device using the fluid chip, and a method for manufacturing the same. In particular, the present invention aims to provide a fluid device in which another member is bonded to an upper surface of a flow passage, a fluid chip suitable for the fluid device, and a method for manufacturing the same

Solution to Problem

In order to solve the aforementioned problems, the fluid chip according to the present invention includes a flow passage formed therein, and the fluid chip has: a base having a top surface constituting at least a part of a bottom surface of the flow passage; and a bonding member formed from an elastomer resin and having an upper end surface provided at a position higher than the top surface of the base; and the base has support post portions projecting to higher than the top surface and demarcating a height of side surfaces of the flow passage, and the support post portions of the base are embedded in the bonding member.

Furthermore, in the fluid chip, the bonding member preferably has self-adhesiveness. In addition, the upper end surface of the bonding member is preferably as high as or higher than upper end surfaces of the support post portions of the base. In addition, it is preferable that the bonding member is mechanically fixed to the base.

Furthermore, in the fluid chip, the base has a continuous or discrete groove along the side surfaces of the flow passage, the bonding member is preferably joined with the base in the groove of the base, further the groove of the base may penetrate the base, the groove of the base may have a constricted portion having a width narrowing in a depth direction of the groove, and the bonding member may have a shape adapted to the constricted portion. Furthermore, the support post portions may be arranged inside the groove of the base.

Furthermore, in the fluid chip, the bonding member preferably constitutes at least a part of the side surfaces of the flow passage. Although the whole bottom surface of the flow passage may be composed of the top surface of the base and the whole side surface of the flow passage may be composed of the bonding member, the support post portions may constitute the side surfaces of the flow passage.

Furthermore, in the fluid chip, the support post portions may be discretely arranged along the side surfaces of the flow passage, the support post portions may be provided on ends or corners of the side surfaces of the flow passage. In addition, the support post portions need not be exposed to the flow passage.

The fluid device according to the present invention characteristically has any of the aforementioned fluid chips, and a bonded member which is bonded to the upper end surface of the bonding member. Furthermore, in the fluid device, it is preferable that the bonding member has a self-adhesiveness, and the bonded member is bonded using the self-adhesiveness of the bonding member. Also, the bonded member may be a fluid control element, a peripheral circuit, a detection element, or a top plate of the flow passage.

A fluid chip manufacturing method according to the present invention characteristically includes steps of: molding a base with a first material by using a first mold, the base having a top surface constituting a bottom surface of a flow passage and support post portions projecting to higher than the top surface; arranging the base in a second mold; and molding a bonding member with an elastomer resin by using the second mold and the base, such that the support post portions of the base are embedded in the bonding member. Furthermore, in the fluid chip manufacturing method, it is preferable that the base has a groove provided along side surfaces of the flow passage and penetrating the base, and the elastomer resin is fed from a rear surface side of the base through the groove.

In the fluid device manufacturing method according to the present invention, a bonded member is brought into contact with an upper end surface of the bonding member in any of the aforementioned fluid chips to bond the bonded member to the fluid chip.

Effects of Invention

According to the present invention, since the fluid chip has the bonding member formed from the elastomer resin and having the upper end surface provided at a position higher than the top surface of the base constituting the bottom surface of the flow passage, the bonded member can be structurally bonded to the upper surface of the fluid chip by the bonding member. Additionally, since the support post portions projecting to higher than the top surface of the base constituting the bottom surface of the flow passage and demarcating the height of the side surfaces of the flow passage are embedded in the bonding member, the heights of the side surfaces of the flow passage can be securely made almost constant by the support post portions of the base embedded in the bonding member even if the bonding member formed from the elastomer resin is elastically deformed, and the fluid chip having the uniformly-dimensioned flow passage can be provided. In addition, when the self-adhesiveness of the elastomer resin is high, the bonded member can be joined to the bonding member by the upper end surface of the bonding member, use of an adhesive or the like is no longer required, and problems caused by using the adhesive can be solved. Furthermore, since the fluid chip can be manufactured using a two-color molding technique or the like, the fluid chip can be mass-produced at a low cost, and additionally a general fluid chip sharable among a plurality of bonded members can be provided by standardizing the size of the flow passage.

In addition, constituting at least a part of the side surfaces of the flow passage by the bonding member makes it possible to design a fine flow passage while maintaining a bond strength, and therefore the performance of the fluid chip can be expected to be improved. In addition, the base and the bonding member can be integrally fixed to each other by joining the bonding member to the groove of the base. Particularly, when the groove penetrates the base, there are effects that the base and the bonding member can be more firmly integrated, additionally the bonding member can be manufactured using the base as a part of the mold by injecting a material of the bonding member through the groove penetrating the base, and the manufacturing process becomes simple. Furthermore, by providing the constricted portion on the groove, the bonding member having a shape adapted to the constricted portion can be more firmly integrated with the base.

In the fluid device according to the present invention, since the fluid chip has the uniformly-dimensioned flow passage, various experiments such as mixing, reaction, separation, culture, purification, and detection of a solution can be more precisely carried out, and even when experimental results are directly observed or measured, the precision can be improved.

In addition, according to the fluid chip manufacturing method according to the present invention, since the bonding member is formed using the second mold and the base, a gap between the base and the bonding member can be decreased, the base and the bonding member can be mechanically and firmly joined, and a liquid leak-preventing function can also be improved. Furthermore, the fluid device manufacturing method according to the present invention makes it possible to bond the bonded member to the fluid chip through the bonding member by merely bringing the bonded member into contact with the upper end surface of the bonding member of the fluid chip, and a time taken to manufacture the fluid device can be considerably reduced. Other effects will be explained in the following embodiment.

BRIEF DESCRIPTION OF DRAWINGS

FIG. 1 (B) is a right-side view of the fluid chip according to the embodiment of the present invention.

FIG. 1 (C) is a bottom view of the fluid chip according to the embodiment of the present invention.

FIG. 1 (D) is a rear view of the fluid chip according to the embodiment of the present invention.

FIG. 1 (E) is a perspective view of the fluid chip according to the embodiment of the present invention.

FIG. 3 (B) is a right-side view of the base according to the embodiment of the present invention.

FIG. 3 (C) is a bottom view of the base according to the embodiment of the present invention.

FIG. 3 (D) is a rear view of the base according to the embodiment of the present invention.

FIG. 3 (E) is a perspective view of the base according to the embodiment the present invention.

FIG. 5 (B) is a right-side view of the bonding member according to the embodiment of the present invention.

FIG. 5 (C) is a bottom view of the bonding member according to the embodiment of the present invention.

FIG. 5 (D) is a rear view of the bonding member according to the embodiment of the present invention.

FIG. 5 (E) is a perspective view of the bonding member according to the embodiment the present invention.

FIG. 8 (B) is a right-side view of the fluid device according to the embodiment of the present invention.

FIG. 8 (C) is a bottom view of the fluid device according to the embodiment of the present invention.

FIG. 8 (D) is a perspective view of the fluid device according to the embodiment of the present invention.

FIG. 13 (B) is a sectional view of the fluid chip according to the embodiment of the present invention.

FIG. 13 (C) is a rear view of the fluid chip according to the embodiment of the present invention.

FIG. 13 (D) is a front view of a bonded member according to the embodiment of the present invention.

FIG. 13 (E) is a sectional view of the bonded member according to the embodiment of the present invention.

FIG. 13 (F) is a front view of a rear surface side member according to the embodiment of the present invention.

FIG. 14 (B) is a side view of the fluid device according to the embodiment of the present invention.

FIG. 14 (C) is a sectional view of the fluid device according to the embodiment of the present invention.

FIG. 14 (D) is a rear view of the fluid device according to the embodiment of the present invention.

FIG. 14 (E) is an enlarged view of the fluid device according to the embodiment the present invention.

FIG. 18 (B) is a sectional view of the fluid device having the valve structure.

FIG. 18 (C) is an enlarged view of the fluid device having the valve structure.

FIG. 18 (D) is a rear view of a fluid chip.

FIG. 18 (E) is a sectional view of the fluid chip.

DESCRIPTION OF EMBODIMENTS

Summary of the Invention

The fluid chip according to the present invention is provided with a bonding member formed from an elastomer resin, and support post portions of a base, which demarcate a height of side surfaces of a flow passage, and thereby a bonded member is bonded to the fluid chip by the bonding member, and the heights of the side surfaces of the flow passage is securely made constant by the support post portions. Additionally, in the following embodiment, a structure in which the bonding member formed from the elastomer resin is also used as the side surfaces of the flow passage will be explained, but in this structure, a width of the side surfaces of the flow passage should be decreased from the viewpoints of high integration of a fluid device, micronization of the flow passage, and the like. As a result, a contact area between an upper surface of the flow passage and the bonded member is decreased, and therefore the side surfaces theirselves of the flow passage are composed of the bonding member and an area of an upper end surface of the bonding member is increased in order to make a bond strength as high as possible in a limited area. However, in a case of a large area, a sufficient bond strength, or the like, the side surfaces of the flow passage are not necessarily composed of the bonding member (described below as a modification example). In addition, the bonding member formed from the elastomer resin can be manufactured by molding, and the base and the bonding member can be mechanically and firmly joined by molding the bonding member using the base as a part of a mold, so that the liquid leak-preventing function can also be improved. However, the present invention is not limited to this manufacturing method, and the fluid chip may be manufactured by joining a base manufactured as another member with the bonding member through fitting or the like. Note that, if the self-adhesiveness of the bonding member formed from the elastomer resin is sufficiently high for joining the bonded member, another joining means is unnecessary, but if the bond strength is low with only the bonding member or if firm joining is required, another joining means (adhesive, clamp, or the like) may be used.

[Fluid Chip]

Figure 1:
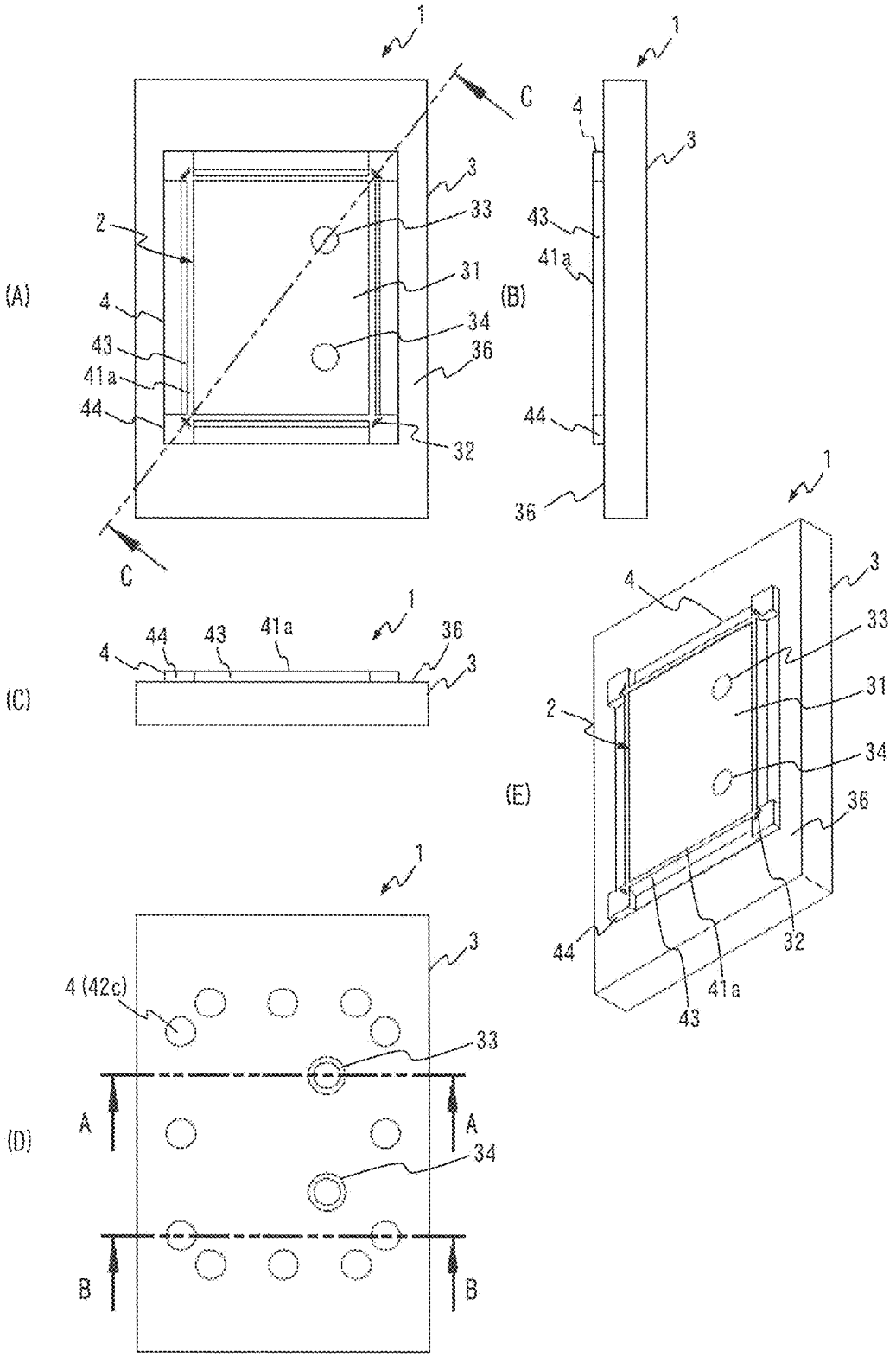
FIG. 1 (A) is a front view of a fluid chip according to an embodiment of the present invention.
Figure 2:
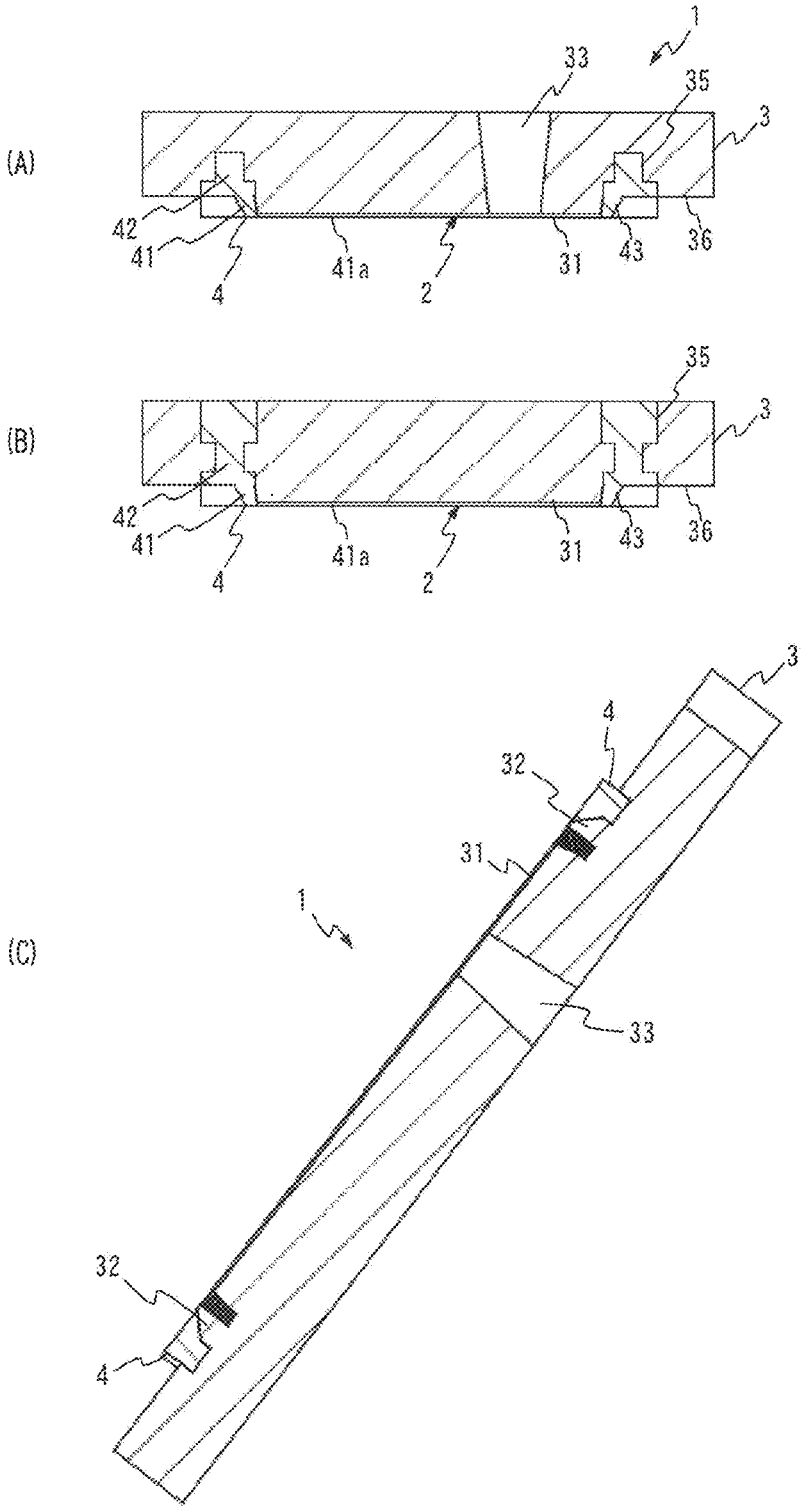
FIG. 2 is sectional views of the fluid chip according to an embodiment of the present invention.

FIG. 1 is schematic diagrams of a fluid chip 1 according to an embodiment of the present invention. FIG. 1 (A) is a front view of the fluid chip 1 when a top surface of the fluid chip 1 is directed forward, FIG. 1 (B) is a right-side view, FIG. 1 (C) is a bottom view, FIG. 1 (D) is a rear view, and FIG. 1 (E) is a perspective view illustrating a front side, a right side, and a bottom side. In the fluid chip 1 in FIG. 1, a plan view and a left-side view are omitted because they coincide with the bottom view and the right-side view, respectively. In addition, FIG. 2 is sectional views of the fluid chip 1 according to the present invention. FIG. 2 (A) is an A-A cross section in FIG. 1 (D), FIG. 2 (B) is a B-B cross section in FIG. 1 (D), and FIG. 2 (C) is a C-C cross section in FIG. 1 (A). Note that, in the figures in the present specification, the dimensions are not necessarily indicated according to the actual dimensional ratios because a height of a microflow passage is fine, and the figures are reference diagrams for understanding the concept of the invention.

The fluid chip 1 according to the present invention includes a flow passage 2 formed on a part of a top surface thereof, and has at least a base 3 and a bonding member 4. The base 3 has a top surface 31 constituting at least a part of a bottom surface of the flow passage 2. The bonding member 4 projects from the base 3 and constitutes at least a part of side surfaces of the flow passage 2.

The flow passage 2 is a space to which a fluid is fed, and is a structure which can be used as a pathway for transferring the fluid, a vessel for pooling and storing the fluid, and a reaction chamber for reacting the fluid. The flow passage 2 includes a recessed portion formed on any part of the top surface of the fluid chip, or a space prepared by providing another member (including a bonded member) as a ceiling in the recessed portion. In addition, the flow passage 2 may extend to the inside of the base or the inside of the bonding member through a hole formed on the base 3 or the bonding member 4, or may be connected to the outside through a through-hole formed on the base 3 or the bonding member 4. In the flow passage 2 according to the present invention, at least a part of the bottom surface is composed of the top surface 31 of the base 3, and the flow passage 2 includes both a structure in which at least a part of the side surfaces is composed of the bonding member 4, and a structure in which at least a part of the side surfaces is composed of only the base 3 or only the bonding member 4. A flow passage with a combination of the base 3 and the bonding member 4 may be provided on a part of the flow passage 2, and a flow passage with only the base 3 or only the bonding member 4 may be provided on the other part of the flow passage 2. The flow passage 2 may have a configuration that the whole bottom surface is composed of the top surface 31 of the base 3, or may have a configuration that a part of the bottom surface is composed of the top surface 31 of the base 3 and the other part of the bottom surface is composed of the bonding member 4. The flow passage 2 may have a configuration that the whole side surface is composed of the bonding member 4, or may have a configuration that a part of the side surfaces is composed of the bonding member 4 and the other part of the side surfaces is composed of the base 3. In particular, when joining the bonded member to an upper surface of the flow passage 2, it is preferable that most or whole of the upper part of the side surfaces of the flow passage 2 in contact with the bonded member is composed of the bonding member 4. For preventing the fluid from leaking from a gap between the base 3 and the bonding member 4 in the flow passage with a combination of the base 3 and the bonding member 4, it is preferable that the whole bottom surface of the flow passage 2 is composed of the top surface 31 of the base 3, and the whole side surface of the flow passage 2 is composed of the bonding member 4. In addition, when the whole bottom surface of the flow passage 2 is composed of the top surface 31 of the base 3, the bottom surface of the flow passage in contact with the fluid can be wholly formed from the same material, so that influence on the fluid caused by difference in materials of the bottom surface can be eliminated. Note that, examples of the fluid fed to the flow passage include a liquid, a gas, and a plasma. Furthermore, a solid (powder or the like) may be blended into the fluid.

In the present invention, the flow passage 2 is preferably a microflow passage. The microflow passage refers to a fine space in which at least one of a height or a width of a flow passage cross section is dimensioned such that a viscous force is more dominant than an inertial force in terms of the fed fluid. For example, the height or the width of the flow passage cross section is 1 mm or smaller, preferably 200 μm or smaller, more preferably 100 μm or smaller. In FIG. 1, a flow passage 2 is a microflow passage having a height of 50 μm, and is a recessed portion which is a fine vessel or fine reaction chamber having a quadrangle shape when viewed from the front. However, the shape of the flow passage 2 is not limited to such a structure, and the shape of the flow passage 2 when viewed from the front may be a pathway of a straight line, a curved line, or a line shape combining the straight and curved lines, or may be a vessel or reaction chamber of a polygon, a circle, an oval or a shape combining the polygon, the circle and the oval, or may be a shape formed by combining, linking, branching, and merging these pathways, vessels and the like.

The base 3 is a member in which at least a part of the bottom surface of the flow passage 2 is formed on the top surface 31. In addition, the base 3 has support post portions 32 projecting to higher than the top surface 31 constituting the bottom surface of the flow passage 2. Furthermore, the base 3 may have through-holes 33 and 34 for connecting the flow passage 2 with the outside. Preferably, at least one of the base 3 and the bonding member 4 has a joining structure for joining the base 3 with the bonding member 4 and fixing the bonding member 4 to the base 3. For example, a groove 35 may be formed in the base 3 for joining the base 3 with the bonding member 4.

The base 3 is formed from a material having higher rigidity than that of the bonding member 4. The required properties of the base 3 vary depending on experimental contents of a fluid and a fluid chip to be used, and the material is selected in consideration of impurity contamination of the fluid, barrier property from the external environment, heat resistance, adsorbability, strength, chemical resistance, transparency, light transmittance, intensity of autofluorescence, and the like. The base 3 is preferably formed from a plastic material, and particularly preferably an engineering plastic excellent in strength and heat resistance, but glass, photoresist, metal, and the like can also be used. Without limitation, cycloolefin polymer (COP), cycloolefin copolymer (COC), polymethacrylic resin (PMMA), polycarbonate (PC), polyethylene (PE), polypropylene (PP), and the like can be used as the base3, for example. The base 3 is preferably manufactured by molding a resin, but may be manufactured by another method. In particular, it is preferable to mold the bonding member 4 using the base 3 as a part of a mold because the base 3 and the bonding member 4 can be integrally manufactured.

Figure 5:
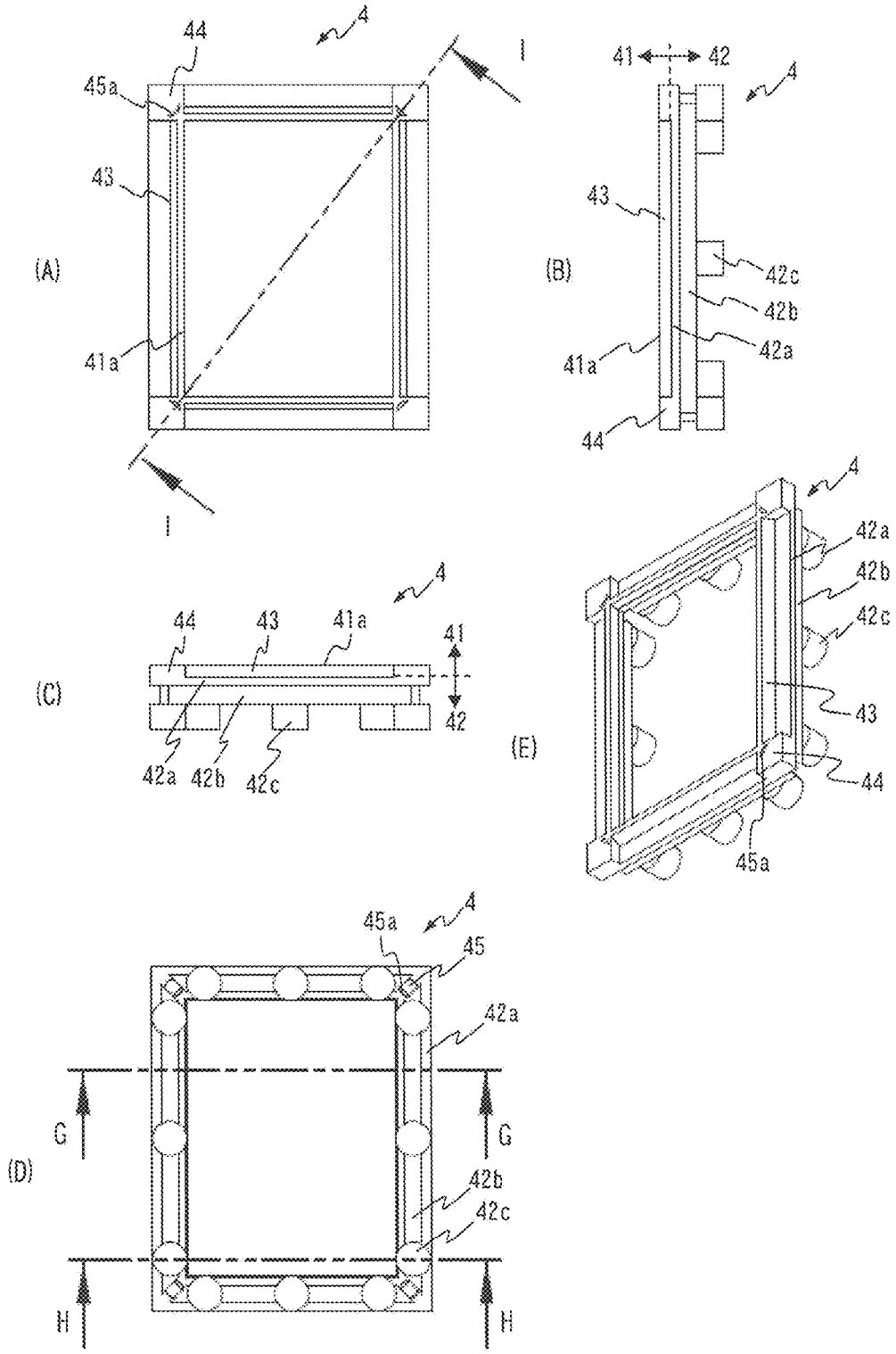
FIG. 5 (A) is a front view of a bonding member according to an embodiment of the present invention.
Figure 6:
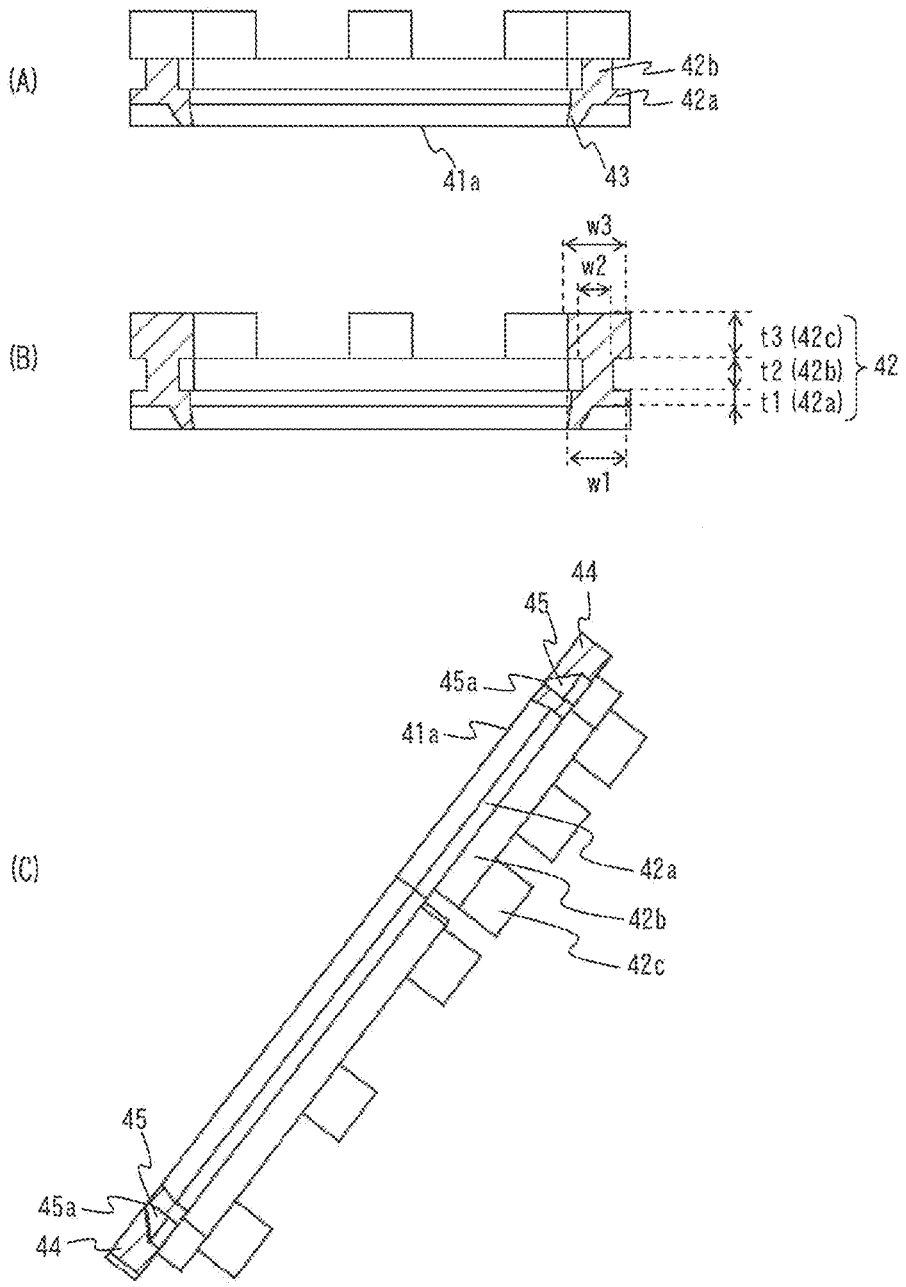
FIG. 6 is sectional views of the bonding member according to an embodiment of the present invention.

The bonding member 4 is formed from an elastomer resin, projects from the base 3, and has an exposed region 41 exposed to outside of the base 3 and a buried region 42 arranged inside the base 3 (see FIG. 5 and FIG. 6). An upper end surface 41*a* of the exposed region 41 functions as a surface bonded with the bonded member. The exposed region 41 is provided so as to constitute at least a part of the side surfaces of the microflow passage, or provided adjacent to and along at least a part of the side surfaces of the microflow passage. The phrase "project from the base 3" means a state that the highest position of the bonding member 4 i.e. the upper end surface 41*a* is provided at a position higher than the top surface 31 as the bottom surface of the flow passage 2 of the base 3. It is preferable that the upper end surface 41*a* of the bonding member 4 is as high as upper end portions of the support post portions 32 of the base 3, but since the bonding member 4 can also be elastically deformed, the upper end surface 41*a* may be higher than the upper end portions of the support post portions 32 as long as the bonding member 4 can be elastically deformed. The bonding member 4 is joined and fixed to the base 3. In particular, the base 3 or the bonding member 4 may be joined such that they cannot be detached unless either the base 3 or the bonding member 4 is broken or remarkably deformed. However, the base 3 and the bonding member 4 may be detachably joined. Since the bonding member 4 is formed from an elastomer resin, the bonding member 4 is easily deformed by an external force, and therefore the support post portions 32 of the base 3 are embedded in the bonding member 4 to demarcate a height of the side surfaces of the flow passage 2. Faces of the bonding member 4 as the side surfaces of the flow passage may be perpendicular to the top surface 31 of the base 3 or may be inclined with respect to the top surface 31. Since the upper end surface 41*a* of the bonding member 4 serves as a face joining with the bonded member, the larger the area of the upper end surface 41*a* is, the higher the bond strength is. Thus, the upper end surface 41*a* of the bonding member 4 is preferably brought into contact with the bonding member as much as possible, and the bonded member-joining face excluding the upper end portions of the support post portions 32 of the base 3 is preferably composed of the bonding member 4.

The elastomer resin constituting the bonding member 4 is a polymer substance having elasticity at normal temperature, which is deformed by applying a force but returns to substantially the original shape and dimension by removing the force. Elastomer resins have self-adhesiveness, but, among the elastomer resins, an elastomer resin having high self-adhesiveness is preferably used. The self-adhesiveness is different from a property of bonding through solidification of a liquid adhesive or the like, and refers to a property of a solid viscoelastic body adheres based on its own viscoelasticity or the like without using any solvent, heat, or the like during bonding. Normally, during removal, the viscoelastic body with the self-adhesiveness can be easily peeled off without leaving any trace on the bonded surface. By adopting the self-adhesive elastomer resin, another member can be bonded to the upper end surface 41*a* of the bonding member 4 by bringing the another member into contact with the upper end surface 41*a* of the bonding member 4. At the time of bonding, the bonded member may be pressurized by being pushed against the upper end surface 41*a* of the bonding member 4 as necessary. Furthermore, the joining strength can be improved by heating during bonding. The elastomer resins may include thermoplastic resins and thermosetting resins. For example, as the thermosetting elastomer resin, a polyurethane-based resin, a polysilicone-based resin, and the like can be used, and as the thermoplastic elastomer resin, a styrene-based resin, an olefin-based resin, a polyester-based resin, and the like can be used. Examples of the olefin-based resin include a polypropylene resin and the like. Examples of the polypropylene resin include ZELAS (registered trademark) manufactured by Mitsubishi Chemical Corporation. Examples of the polyester-based resin include PELPRENE (registered trademark) manufactured by TOYOBO CO., LTD., Hytrel (registered trademark) manufactured by DU PONT-TORAY CO., LTD, and the like. The type of the elastomer resin is not limited to these types. The elastomer resin constituting the bonding member may be one type or a mixture of plural types of the aforementioned resins.

A melt flow rate (MFR) of the elastomer resin is preferably 10 g/10 min or lower as a mold for the bonding member 4 from the viewpoint of excellent releasability from a mold used in combination with the base 3. In the present specification, the "melt flow rate" refers to a value measured at a test temperature of 230° C. and a test load of 21.2 N in accordance with JIS K 7210: 1999.

The bonding member 4 may contain an additive other than the elastomer resin (e.g. an adhesion-imparting agent) as necessary. The bonding member 4 is preferable because it can be manufactured by molding the elastomer resin, particularly because the base 3 and the bonding member 4 can be integrally manufactured by molding the bonding member 4 using the base 3 as a part of a mold.

Figure 3:
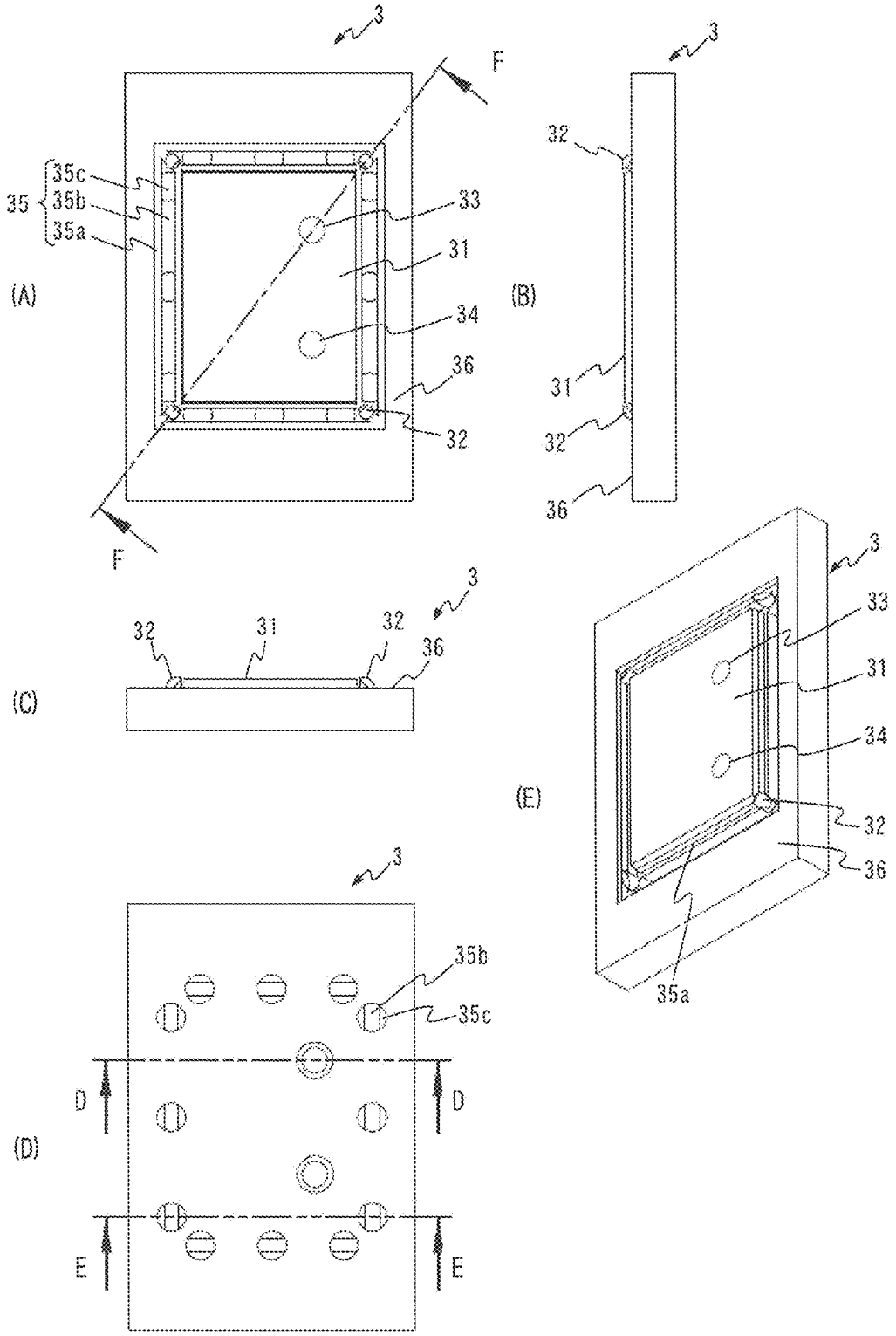
FIG. 3 (A) is a front view of a base according to an embodiment of the present invention.
Figure 4:
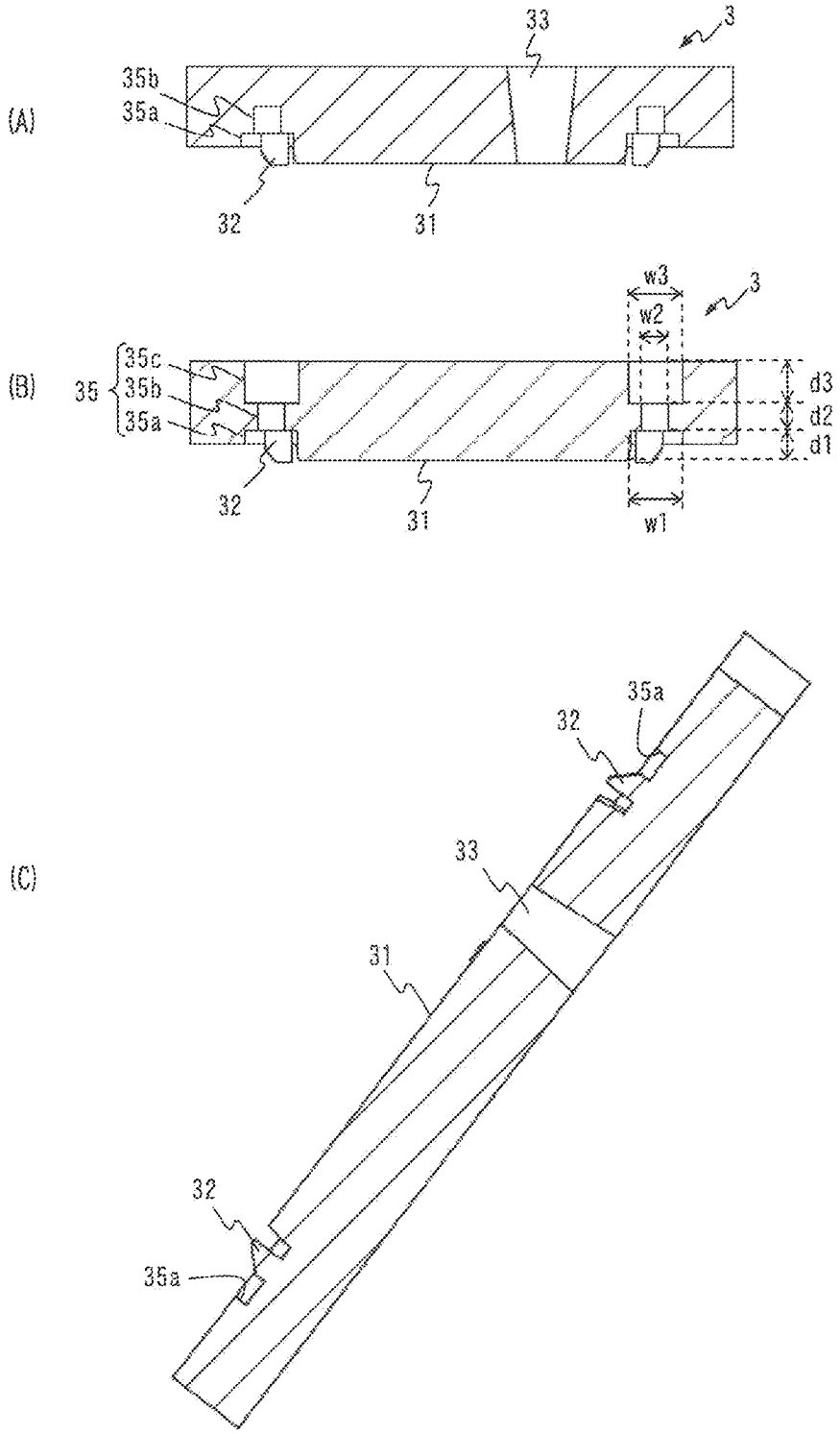
FIG. 4 is sectional views of the base according to an embodiment of the present invention.

Next, a specific structure and bonding structure of the base 3 and the bonding member 4 in this embodiment will be explained with reference to FIG. 1 and FIG. 2 together with FIG. 3 and FIG. 4 illustrating only the base 3 in FIG. 1 and FIG. 2, as well as FIG. 5 and FIG. 6 illustrating only the bonding member 4 in FIG. 1 and FIG. 2.

FIG. 3 is schematic diagrams illustrating an embodiment of the base 3 of the fluid chip 1 in FIG. 1, FIG. 3 (A) is a front view, FIG. 3 (B) is a right-side view, FIG. 3 (C) is a bottom view, FIG. 3 (D) is a rear view, and FIG. 3 (E) is a perspective view illustrating a front side, a right side, and a bottom side. Also in the base 3 in FIG. 3, the plan view coincides with the bottom view, and the left-side view coincides with the right-side view. FIG. 4 is sectional views of the base 3, FIG. 4 (A) is a D-D cross section in FIG. 3 (D), FIG. 4 (B) is an E-E cross section in FIG. 3 (D), and FIG. 4 (C) is an F-F cross section in FIG. 3 (A).

In addition, FIG. 5 is schematic diagrams illustrating an embodiment of the bonding member 4 of the fluid chip 1 in FIG. 1, FIG. 5 (A) is a front view, FIG. 5 (B) is a right-side view, FIG. 5 (C) is a bottom view, FIG. 5 (D) is a rear view, and FIG. 5 (E) is a perspective view illustrating a front side, a right side, and a bottom side. Also in the bonding member 4 in FIG. 5, the plan view is the same as the bottom view, and the left-side view is the same as the right-side view. FIG. 6 is sectional views of the bonding member 4, FIG. 6 (A) is a G-G cross section in FIG. 5 (D), FIG. 6 (B) is an H-H cross section in FIG. 5 (D), and FIG. 6 (C) is an I-I cross section in FIG. 5 (A).

When viewed from the front, a whole outer shape of the base 3 in this embodiment is quadrangle, and provided with the quadrangle top surface 31 serving as a bottom surface of the flow passage 2, the annular groove 35 around the top surface 31, and a peripheral portion 36 around the groove 35. The support post portions 32 are formed on four corners of the groove 35, and the through holes 33 and 34 are formed in the top surface 31.

The top surface 31 of the base 3 constitutes at least a part of the bottom surface of the flow passage 2. In this embodiment, the top surface 31 is higher than the top surface of the peripheral portion 36. The reason why the top surface 31 is made higher is because a gap between the peripheral portion 36 of the base 3 and the peripheral portion of the bonded member is broadened when bonding the bonded member. For example, when a sensor is adopted as the bonded member, this gap makes it possible to arrange terminals, wires, and the like for connecting the sensor with an outside of the sensor. If there is no particular need, the top surface 31 may be as high as the peripheral portion 36. Furthermore, in this embodiment, although the top surface 31 is a plane having a constant height, the height of the top surface 31 (height of the side surfaces of the flow passage) may be changed depending on the flow passage region, or the top surface 31 may be an inclined plane or a curved surface.

The groove 35 of the base 3 may be continuously or discretely provided along the side surfaces of the flow passage, and a part or whole of the groove 35 may penetrate the base 3 to the rear surface of the base 3. In this embodiment, the groove 35 provided on the base 3 is composed of a top surface side groove 35*a*, an intermediate groove 35*b*, and rear surface side grooves 35*c* which have different depths, as illustrated in FIG. 4 (B). The top surface side groove 35*a* is provided on the top surface 31 side, has a first depth d1 and a first width w1, and is formed in a quadrangle-annular shape so as to surround the top surface 31 as illustrated in FIG. 3 (A). The intermediate groove 35*b* is formed inside the top surface side groove 35*a* and at a position deeper than the top surface side groove 35*a*, and has a second depth d2 and a second width w2 narrower than the first width w1. As illustrated in FIG. 3 (A), the intermediate groove 35*b* is formed inside the top surface side groove 35*a* excluding the four corners having the support post portions 32. The rear surface side grooves 35*c* are circular grooves having a third depth d3 and a third width w3 as a diameter larger than the second width w2 provided on the rear surface side, the circular portions in FIG. 3 (D) are the outlines of the rear surface side grooves 35*c*, and the straight lines inside the circles is a part of the outline of the intermediate groove 35*b* viewed through the rear surface side grooves 35*c*. Note that, in FIG. 3 (A), a part of the circular outlines of the rear surface side grooves 35*c* is shown inside the intermediate groove 35*b*. As described above, the groove 35 includes the grooves having the first width w1, the second width w2 smaller than the first width w1, and the third width w3 larger than the second width w2 in the depth direction. The groove 35 has a constricted portion and can firmly fix the bonding member 4 having a shape adapted to the constricted portion. Note that, in this embodiment, both a top surface side and a rear surface side of the constricted portion are broadened, but it is sufficient to provide a wide portion at least on the rear surface side. Furthermore, the intermediate groove 35*b* only needs to be arranged at least on portions on which the rear surface side grooves 35*c* are arranged, and a number and an arrangement of the rear surface side grooves 35*c* may be appropriately set in consideration of a size and shape of the flow passage, a material of the bonding member 4, and the like.

The support post portions 32 of the base 3 demarcate the height of the side surfaces of the flow passage 2 and project to higher than the top surface 31 of the base 3. A height from the top surface 31 of the base 3 to upper end portions 32*a* of the support post portions 32 corresponds to the height of the side surfaces of the flow passage. In this embodiment, the height from the top surface 31 of the base 3 to the upper end portions 32*a* of the support post portions 32 is about 50 μm. The support post portions 32 are continuously or discretely provided along the side surfaces of the flow passage 2. In particular, it is preferable that the support post portions 32 are arranged at ends or corners of the side surfaces because each side surface can be demarcated by two points. When the support post portions 32 are continuously provided on the side surfaces of the flow passage, the side surfaces of the flow passage 2 may be composed of the support post portions 32. In this case, the support post portions 32 serve as walls of the flow passage. Although the support post portions 32 are embedded in the bonding member 4, it is sufficient that at least a part of the peripheries of the support post portions 32 is embedded in the bonding member 4. Additionally, in the case that a plurality of support post portions 32 are provided, all of the support post portions may be embedded in the bonding member 4, but at least some of the support post portions only need to be embedded in the bonding member 4. By embedding the support post portions 32 in the bonding member 4, a strength of the support post portions 32 can be improved, the fluid chips can be integrated, and also the function of ensuring a constant height of the bonding member can be improved. When the support post portions 32 are embedded in the bonding member 4, the upper end portions 32*a* of the support post portions 32 may be exposed to the upper end surface of the bonding member 4, and therefore it is preferable to lessen the upper end portions 32*a* of the support post portions 32 for broadening the face joining with the bonding member 4. The support post portions 32 in FIG. 3 and FIG. 4 have a shape obtained by obliquely cutting an upper surface of a column, and the upper end portions 32*a* are thin arc-shaped. When the support post portions 32 are embedded in the bonding member 4, an effect is also exhibited in that the strength can be secured even if the upper end portions of the support post portions 32 are thinned. The shape of the support post portions 32 is not limited to such a structure, and may be e.g. a prism shape, a truncated pyramid shape, a plate shape, a crossed column shape, a truncated cone shape, or a combination thereof.

The through-holes 33 and 34 of the base 3 make it possible to connect the flow passage 2 with the outside on the rear surface side of the base. For example, the through-hole 33 may serve as a fluid feed port for feeding the fluid to the flow passage 2, and the through-hole 34 may serve as a fluid discharge port for discharging the fluid in the flow passage 2. The rear surfaces of the through-holes 33 and 34 may be configured to be connectable with the external fluid device or the flow passage. Note that, the fluid feed port and the fluid discharge port of the flow passage 2 are not necessarily the through-holes of the base 3, and for example, the fluid feed port and the fluid discharge port may be provided on the bonded member.

When viewed from the front, the whole external shape of the bonding member 4 in this embodiment is a quadrangle-annular shape along the side surfaces of the flow passage 2. Wall portions 43 are formed in the exposed region 41 as the side surfaces of the flow passage 2, wide corner portions 44 are formed on four corners of the exposed region 41, and a first layer 42*a*, a second layer 42*b*, and a third layer 42*c* are formed in the buried region 42.

The exposed region 41 of the bonding member 4 is exposed to the outside of the base 3, and has the upper end surface 41*a* configured to be bondable with the bonded member. The exposed region 41 has the upper end surface 41*a* configured to be as high as or higher than the upper end portions of the support post portions 32 of the base 3. On the exposed region 41, the bonding member 4 is provided as at least a part of the side surfaces of the flow passage 2, or provided adjacent to and along at least a part of the side surfaces of the flow passage 2, and is configured to allow the bonded member to bond to the upper surface of the flow passage 2. In this embodiment, the upper surfaces of the wall portions 43 and the corner portions 44 serve as the upper end surface 41*a*.

The wall portions 43 are structures constituting at least a part of the side surfaces of the flow passage 2. The upper surfaces of the wall portions 43 serve as an upper end surface 41*a* in contact with the bonded member. It is preferable that the whole upper surface of the side surfaces of the flow passage 2 is composed of the wall portions 43 constituted by the bonding member 4. As for a microfluid chip, a bonding area with the bonded member is limited in some cases, and in this case, it is preferable that the side surfaces theirselves of the flow passage 2 are composed of the bonding member 4, and the area of the upper end surface 41*a* of the bonding member 4 is increased. Note that, in this embodiment, the upper end surface 41*a* of the wall portions 43 has a width of about 200 μm, and a height of the upper end surface 41*a* from the top surface 31 of the base 3 (height of the exposed region 41) is about 50 μm.

Figure 7:
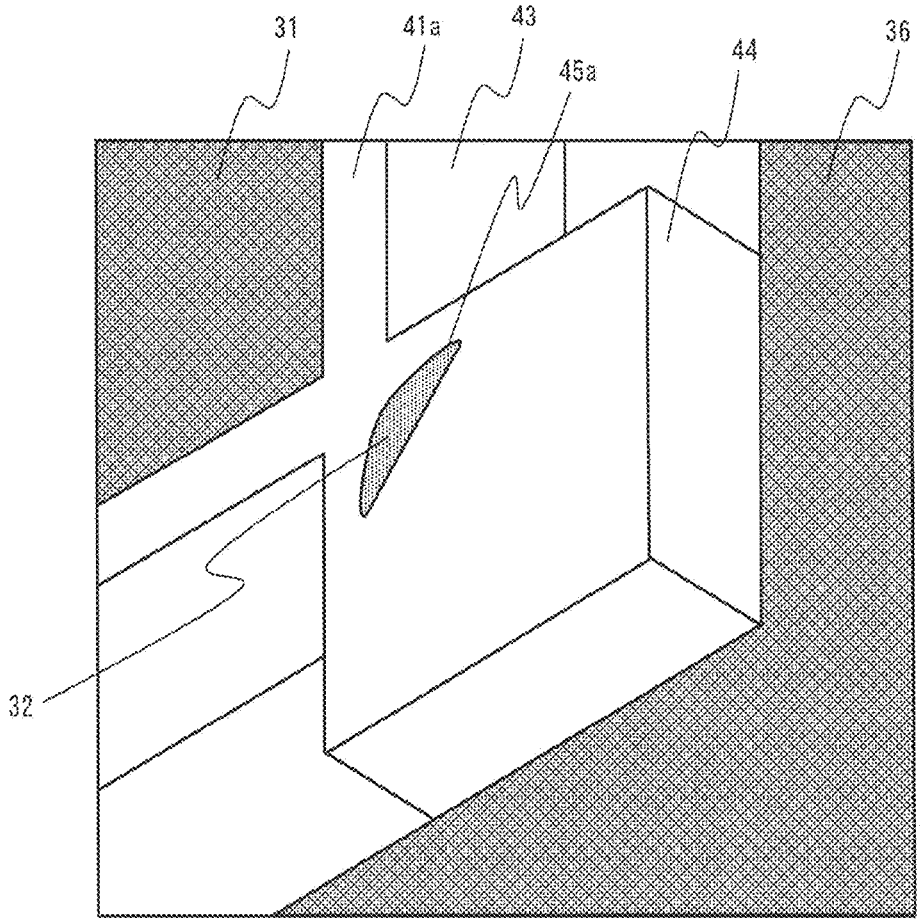
FIG. 7 is an enlarged view of a corner portion of the bonding member.

The corner portions 44 are regions provided on corners or ends of the flow passage 2 and formed to be wider than the width of the wall portions 43 formed on both ends of each side of the side surfaces of the flow passage 2. On the corner portions 44, the bond strength is increased by increasing the area of the upper end surface 41*a* of the bonding member 4. Furthermore, when the corner portions 44 are broadened, the support post portions 32 of the base 3 can be embedded, and the bond strength can be secured even if the upper end portions of the support post portions 32 are exposed. In this embodiment, the upper end surface 41*a* of the corner portion 44 is a square of about 1 mm square, which secures the bond strength. In addition, as is clear from the rear view in FIG. 5 (D) and the sectional view in FIG. 6 (C), since the support post portions 32 of the base 3 are embedded in the corner portions 44, the portions where the support post portions 32 are arranged serve as embedded spaces 45. The embedded spaces 45 in this embodiment have a shape corresponding to a shape obtained by obliquely cutting the upper surface of a cylinder as the shape of the support post portions 32, and has an arced opening 45*a* on the top surface of the corner portion 44. FIG. 7 is an enlarged view of a corner portion 44 of the fluid chip 1, in which the upper end portion of the support post portion of the base 3 is exposed from the opening 45*a*, and the other part of the support post portion is embedded in the bonding member 4. Note that, the upper end portion of the support post portion 32 may be thinly covered with the bonding member 4 to increase the bond strength.

The buried region 42 is buried inside the base 3 and preferably has a function of combining with the base 3 to fix the bonding member 4 to the base 3. The buried region 42 has e.g. a shape corresponding to the groove 35 of the base 3, and this shape is combined with the shape of the groove 35 to fix the bonding member 4 to the base 3. As illustrated in FIG. 6 (B), the buried region 42 in this embodiment is composed the first layer 42*a*, the second layer 42*b*, and the third layer 42*c* having different depths. The first layer 42*a* has a shape corresponding to the top surface side groove 35*a* of the base 3, and is formed in a quadrangle-annular shape as illustrated in FIG. 5 (A), having the first width w1 and a first height t1. The first height t1 corresponds to the depth from the top surface of the peripheral portion 36 around the top surface side groove 35*a* of the base 3. When the bonding member 4 is arranged in the groove 35 of the base 3, the upper surface of the exposed region 41 of the bonding member 4 excluding the wall portions 43 and the corner portions 44 is as high as the top surface of the peripheral portion 36 of the base 3, constituting a continuous surface. The second layer 42*b* has a shape corresponding to the intermediate groove 35*b* of the base 3, and has a second width w2 smaller than the first width w1 and a second height t2. As illustrated in FIG. 5 (D), the second layer 42*b* is formed inside the first layer 42*a* and along each side excluding the four corners in the quadrangle-annular shape. The second height t2 corresponds to the second depth d2 of the intermediate groove 35*b* of the base 3. The third layer 42*c* has a shape corresponding to the rear surface side grooves 35*c* of the base 3, which is a circular structure having a diameter which is the third width w3 larger than the second width w2, and having a third height t3. The third height t3 corresponds to the third depth d3 of the rear surface side grooves 35*c* of the base 3. In the buried region 42, the first layer 42*a* having the first width w1, the second layer 42*b* having the second width w2 smaller than the first width w1, and the third layer 42*c* having the third width w3 larger than the second width w2 are formed. The buried region 42 has a shape adapted to the constricted portion of the groove, and can be combined with the base 3 having the constricted portion to firmly fix the bonding member 4. Note that, the shape of the buried region 42 does not necessarily completely correspond to the groove 35 of the base 3 as long as the buried region 42 can be combined with the base 3 to fix the bonding member 4 to the base 3. The structures in FIG. 5 and FIG. 6 are merely embodiments.

[Fluid Device]

Figure 8:
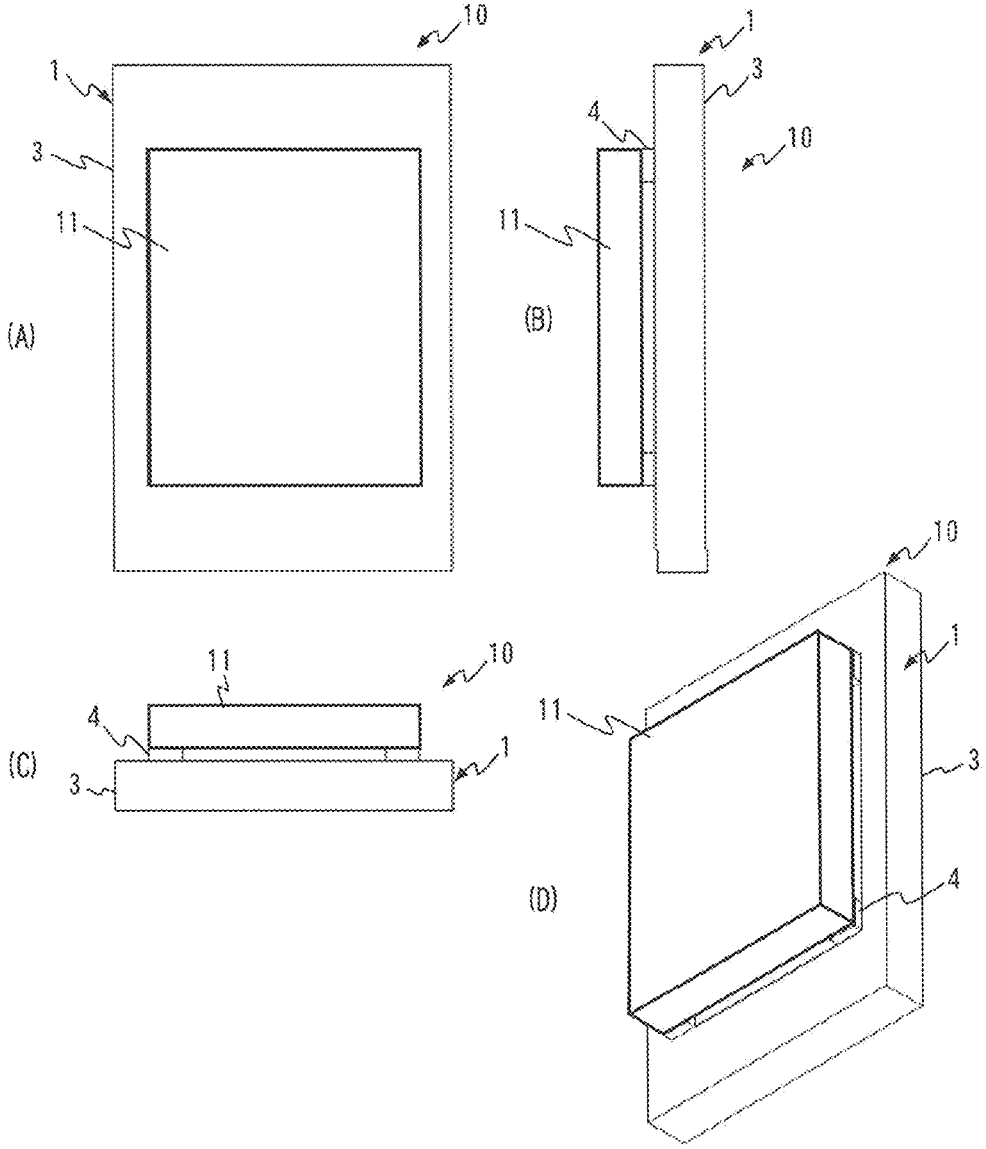
FIG. 8 (A) is a front view of a fluid device according to an embodiment of the present invention.

FIG. 8 is schematic diagrams of a fluid device 10 according to an embodiment of the present invention. FIG. 8 (A) is a front view of the fluid chip 1 when a top surface of the fluid chip 1 is directed forward, FIG. 8 (B) is a right-side view, FIG. 8 (C) is a bottom view, FIG. 8 (D) is a perspective view illustrating a front side, a right side, and a bottom side. In the fluid device 10 in FIG. 1, the rear view, the plan view, and the left-side view are omitted because they coincide with the rear view of the fluid chip, the bottom view, and the right-side view, respectively. The fluid device 10 according to the present invention includes the fluid chip 1 and a bonded member 11 which is bonded to the upper surface of the fluid chip 1.

The bonded member 11 is disposed on the upper surface of the flow passage 2 of the fluid chip 1 and is bonded to the upper end surface of the bonding member 4. For example, the bonded member 11 may be a member having functionalities, such as a fluid control element (micropump, microvalve, micromixer, filter), a peripheral circuit (heating means, cooling means, luminescent means), a detection element (various sensors), or may be simply a member functioning as a ceiling. If the bonded member 11 is a detection system such as an image sensor and a biosensor, the sensor can be brought into direct contact with the fluid, and a detection sensitivity and the like can be improved. The bonded member 11 includes a resin, a glass, a semiconductor, a metal, an inorganic substance, or the like, the material is not particularly limited as long as the bonded member 11 is bondable by the bonding member 4.

In FIG. 8, the bonded member 11 is quadrangle and has a size substantially equivalent to the outer shape of the bonding member 4, but the bonded member 11 may be larger than the bonding member 4. Additionally, in the fluid chip explained with reference to FIG. 1 to FIG. 6, the height of the peripheral portion 36 is decreased, and further the upper surface of the exposed region 41 of the bonding member 4 excluding the wall portions 43 and the corner portions 44 is set to be as high as the top surface of the peripheral portion 36 of the base 3, so that a gap is formed between the bonded member and the fluid chip on the four sides of the bonded member 11. In this gap, terminals, wirings, and the like for connecting the bonded member 11 to the outside can be arranged.

In the fluid device 10 according to the present invention, the bonded member 11 can be bonded to the upper surface of the flow passage by the bonding member 4, and a volume of the flow passage can be set to a predetermined amount, because the height of the side surfaces of the flow passage 2 is kept constant by the support post portions 32 of the base 3 even if the bonding member 4 formed from an elastomer resin is deformed. In particular, in using the fluid device 10, even when performing an experiment by pressing the fluid chip 1 and the bonded member 11 with a constant load, the height of the side surfaces of the flow passage 2 can be kept constant by the support post portions 32 of the base 3. Furthermore, by using the self-adhesiveness of the bonding member 4 for bonding the fluid chip 1 with the bonded member 11, an adhesive is not required, and problems resulting from use of the adhesive can be solved.

[Method for Manufacturing Fluid Chip]

Figure 9:
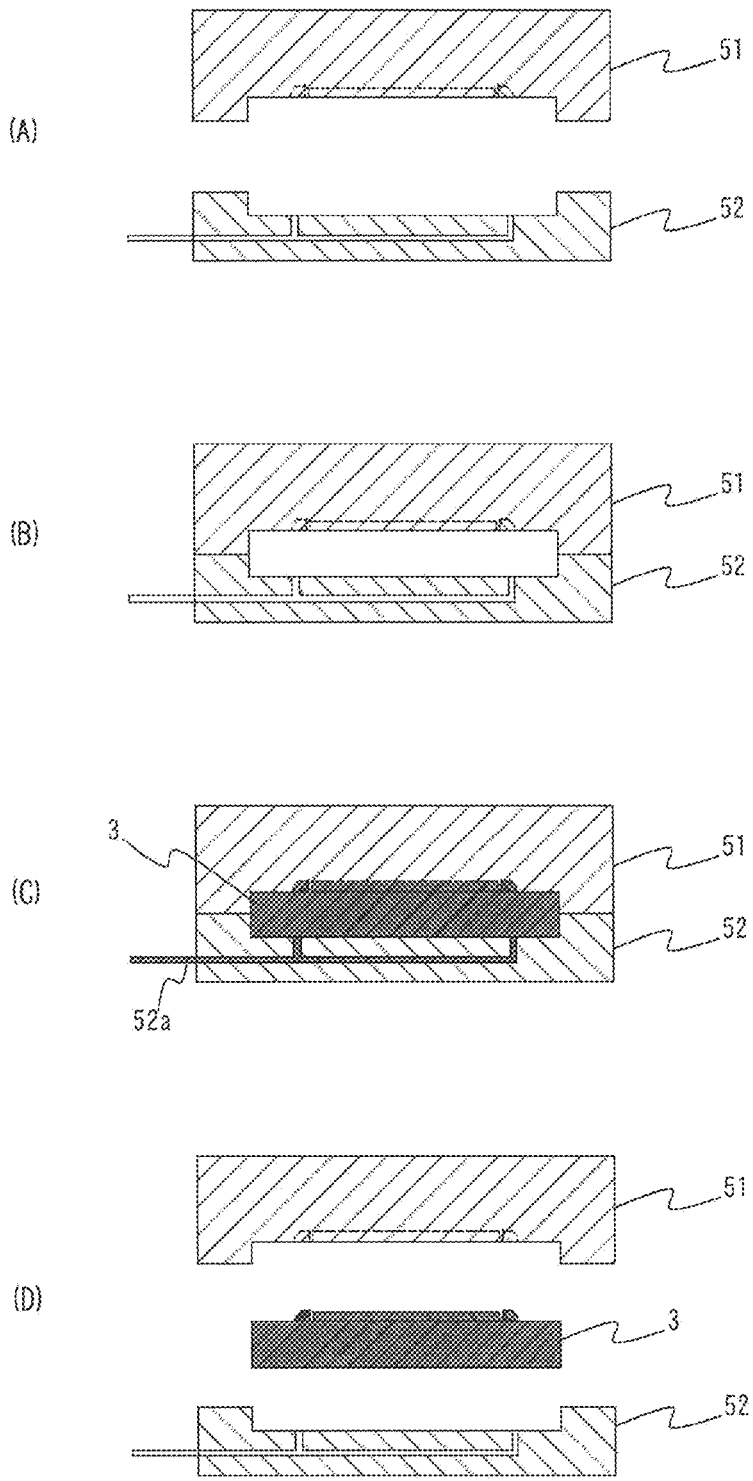
FIG. 9 is diagrams for explaining a fluid chip manufacturing method.
Figure 10:
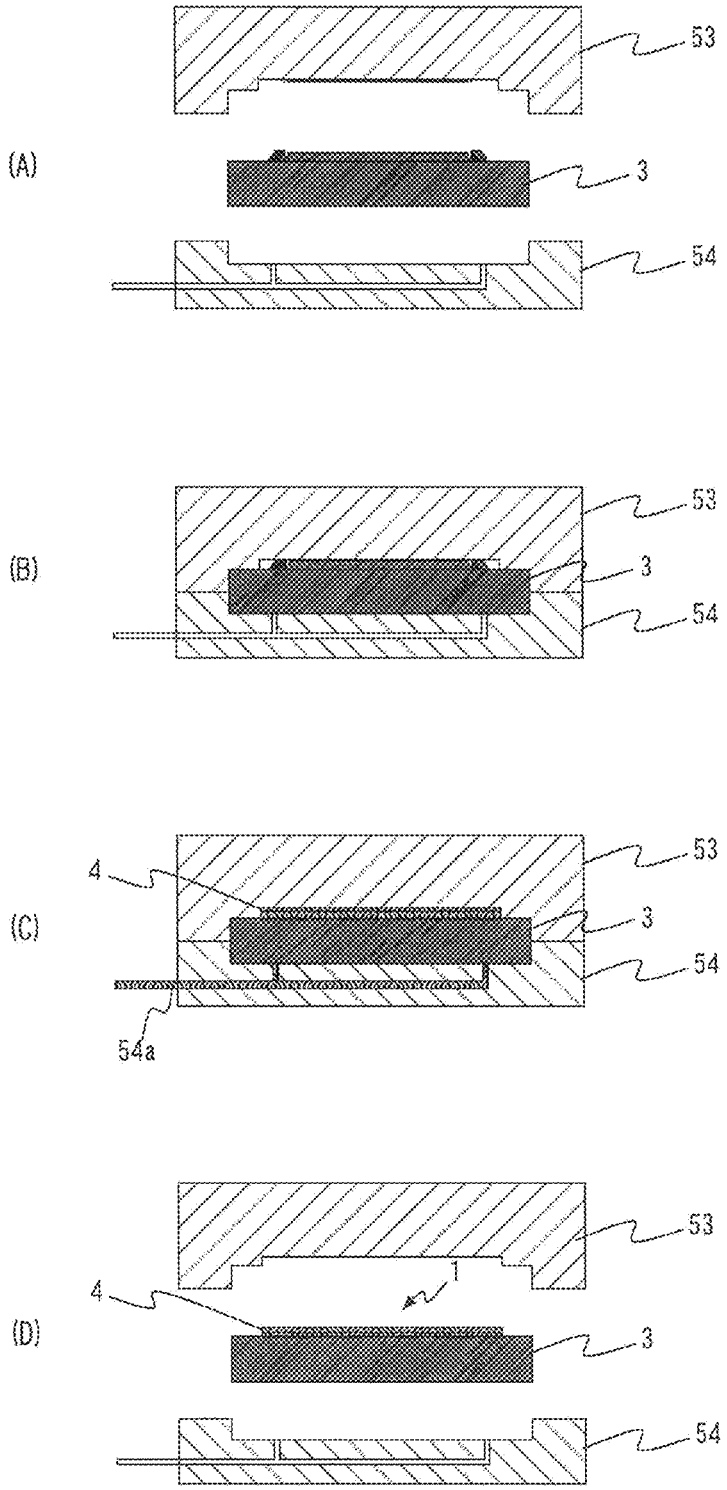
FIG. 10 is diagrams for explaining the fluid chip manufacturing method.

FIG. 9 and FIG. 10 are diagrams for explaining methods for manufacturing the fluid chip 1. FIG. 9 is diagrams for explaining steps for manufacturing the base 3 of the fluid chip 1, and FIG. 10 is diagrams for explaining steps for manufacturing the bonding member 4. As illustrated in FIG. 9, a pair of first molds 51 and 52 for molding the base 3 are prepared (FIG. 9 (A)), and the pair of first molds 51 and 52 are clamped to each other (FIG. 9 (B)). A space formed by the pair of first molds 51 and 52 has a shape of the base 3. The first material is injected into this space from an injection port 52*a*, and the first material is cured in the first molds 51 and 52 to manufacture the base 3 (FIG. 9 (C)). Subsequently, the first molds 51 and 52 are separated, and the base 3 as a molded article is taken out.

Next, as illustrated in FIG. 10, the molded base 3 and a pair of second molds 53 and 54 are prepared (FIG. 10 (A)), and the pair of second molds 53 and 54 are clamped to each other so as to envelop the base 3 (FIG. 10 (B)). A space formed by the base 3 and the pair of second molds 53 and 54 has a shape corresponding to the bonding member 4. An elastomer resin as the second material is injected into this space from an injection port 54*a*, and the second material is cured in the second molds 53 and 54 to manufacture the bonding member 4 (FIG. 10 (C)). Herein, the elastomer resin is also injected into the groove 35 of the base 3, and the buried region 42 is also manufactured so as to correspond to the shape of the groove 35 of the base. Subsequently, the second molds 53 and 54 are separated, and the fluid chip 1 as a molded article is taken out.

In FIG. 9 and FIG. 10, the pair of first molds and the pair of second molds were used for manufacture, but, in the first molds for molding the base, a part (e.g. the peripheral portion 36 and the top surface 31) having the shape in common with the second molds for manufacturing a bonding resin may be used as a common mold. That means, after the base 3 is manufactured by the first molds, a mold of an exchanged part is removed while the common mold is left as it is, a mold for the bonding resin is attached to the part and used as the second mold, and the second material is used to manufacture the bonding member. Such a manufacturing step can be achieved by using a two-color molding technique.

[Method for Manufacturing Fluid Device]

The fluid device is manufactured by a process that the bonded member 11 is arranged at a predetermined position on the upper surface of the flow passage of the fluid chip 1, and the bonded member 11 is brought into contact with the upper end surface 41*a* of the bonding member 4 to bond the bonded member 11 to the fluid chip 1. The bonded member 11 may be pressed against the upper end surface 41*a* of the bonding member 4 as necessary. If the bond strength caused by the self-adhesiveness of the bonding member 4 is sufficiently high to join the bonded member 11, bonding with only the self-adhesiveness of the bonding member 4 is sufficient, but if the bond strength of the bonding member 4 alone is low, or if a joining requires a bond strength higher than the bond strength caused by the self-adhesiveness, another joining means may be used. For example, a contacting portion between the bonding member 4 and the bonded member 11, or an outer periphery of the contacting portion may be bonded with an adhesive, or alternatively the bonded member 11 may be fixed to the fluid chip with a clamp.

Modification Example

Figure 11:
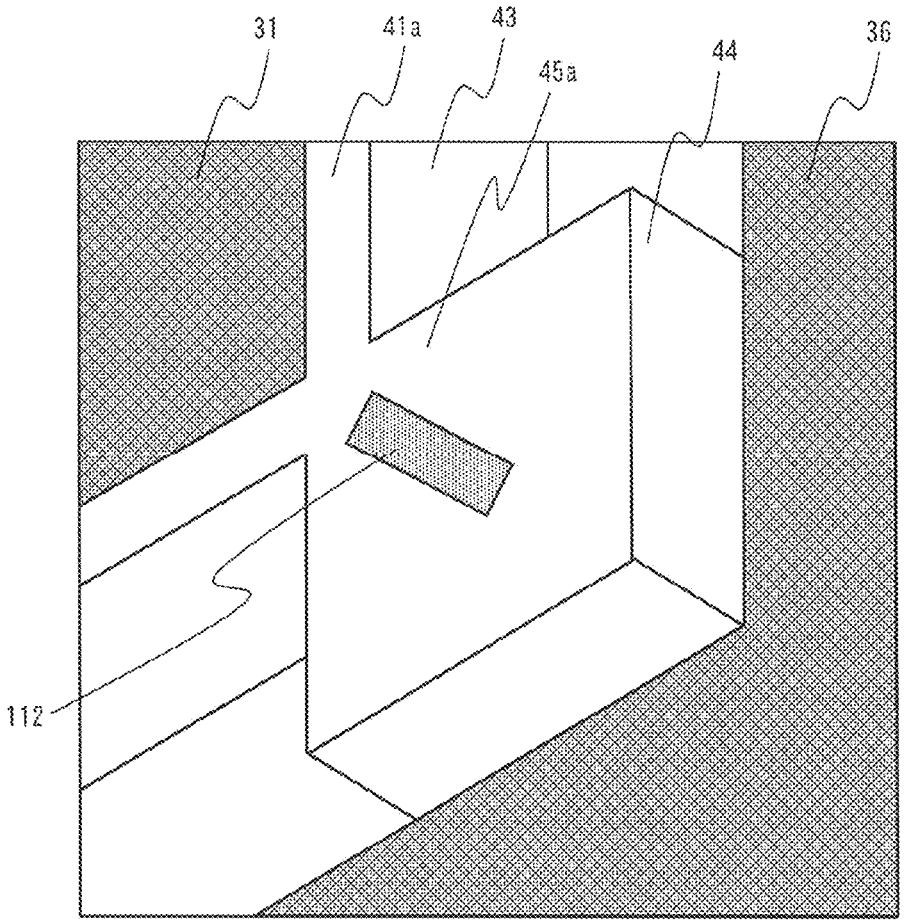
FIG. 11 is a diagram illustrating a modification example of the present invention.

The fluid chip according to the present invention is not limited to the aforementioned embodiment, and can be appropriately modified within a range of comprehension of those skilled in the art. FIG. 11 illustrates a modification example of support post portions 112. In FIG. 11, although an embedded portion is not illustrated, a plate-like quadrangular prism-shaped structure is adopted as the support post portions 112, and therefore the openings 45*a* of the corner portions 44 of the bonding member are rectangular, from which upper end portions of the rectangular support post portions 112 are exposed. The support post portions 112 are arranged at four corners (corner portions 44 of the bonding member) so as to be oblique with respect to the side surfaces of the flow passage 2 (wall portions 43 of the bonding member 4). In such a way, as a result of arranging the support post portions 112 so as to be oblique with respect to the side surfaces extending from the corners, an effect of equalizing the heights of the side surfaces formed by the support post portions 112 on all side surfaces in contact with the corners can be exerted, and the heights of the side surfaces can be maintained by the discretely arranged support post portions 112.

Figure 12:
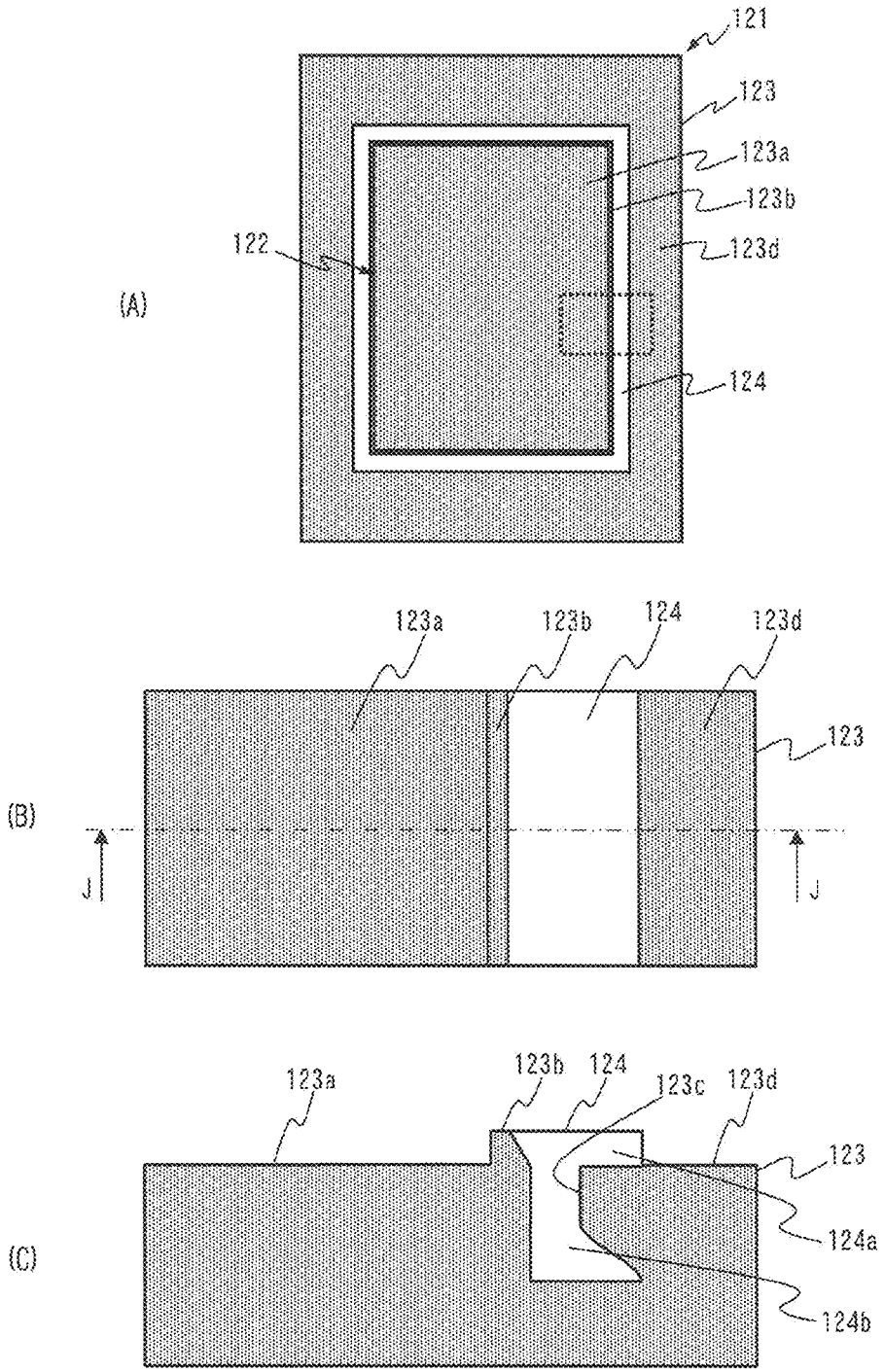
FIG. 12 is diagrams illustrating a modification example of the present invention.

FIG. 12 illustrates an example of a fluid chip 121 in which whole bottom and side surfaces of a flow passage 122 are composed of a base 123. FIG. 12 (A) is a general front view, FIG. 12 (B) is an enlarged view of a dashed line part in FIG. 12 (A), and FIG. 12 (C) is a sectional view taken along J-J in FIG. 12 (B). In the fluid chip 121 in FIG. 12, the base 123 has a plate-like support post portion 123*b* which vertically projects from a top surface 123*a* of the base constituting the bottom surface of the quadrangular flow passage 122 and constitutes the side surface of the flow passage 122. A height of the side surface of the flow passage is maintained by the support post portion 123*b* as the side surface of the flow passage. Furthermore, a groove 123*c* is formed on the base 123 outside the support post portion 123*b* and along the support post portion. The groove 123*c* does not penetrate the base, but has a broader width at a deep side compared to the top surface side, and includes a constricted portion. Note that, in the modification example of FIG. 12, a top surface of a peripheral portion 123*d* of the base 123 is as high as the bottom surface of the flow passage 122. A bonding member 124 is provided outside the support post portion 123*b* as the side surface of the flow passage 122 and along the side surface. An exposed region 124*a* of the bonding member 124 extends like a belt in parallel with the side surface of the flow passage so as to cover the outer portion of the support post portion. A buried portion 124*b* of the bonding member 124 is filled in the groove 123*c* of the base 123 and has a shape of the constricted portion. In the joint structure between the base and the bonding member in FIG. 12, the constricted portion is obliquely broadened in the depth direction from the top surface to make it difficult to separate the base and the bonding member, and also it is difficult to attach them to each other from the separated state. As illustrated in the modification example in FIG. 12, a bonded member is arranged so as to overlap with the upper end surface of the bonding member 124 of the fluid chip 121, and is brought into contact with an upper end surface of the bonding member 122, so that the bonded member can be bonded to an upper surface of the flow passage 122. The side surface of the flow passage is composed of the support post portion 123*b* of the base 123, and the height of the side surface is regulated to be constant.

[Step of Bonding the Bonded Member]

Figure 13:
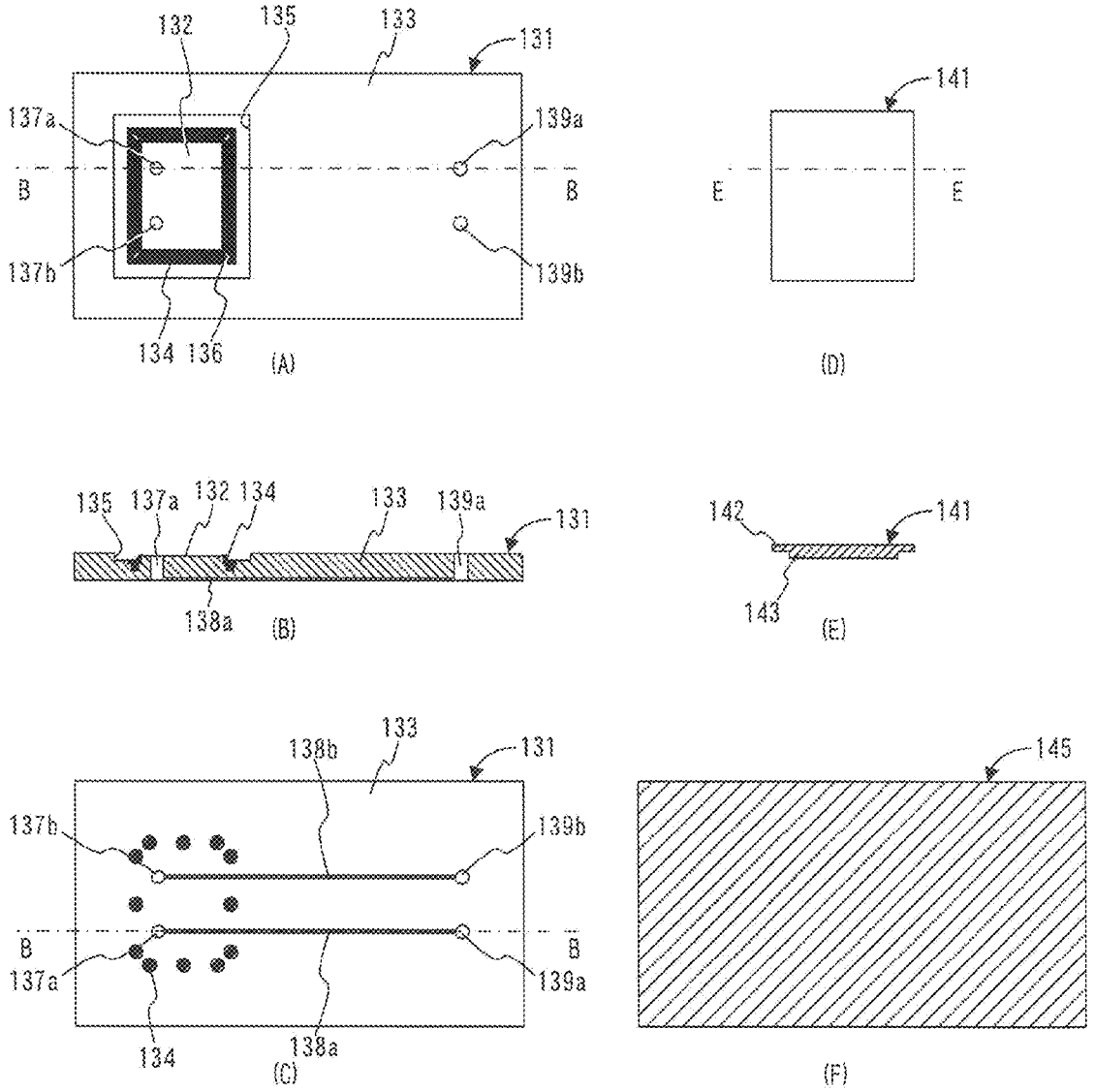
FIG. 13 (A) is a front view of a fluid chip according to another embodiment of the present invention.
Figure 14:
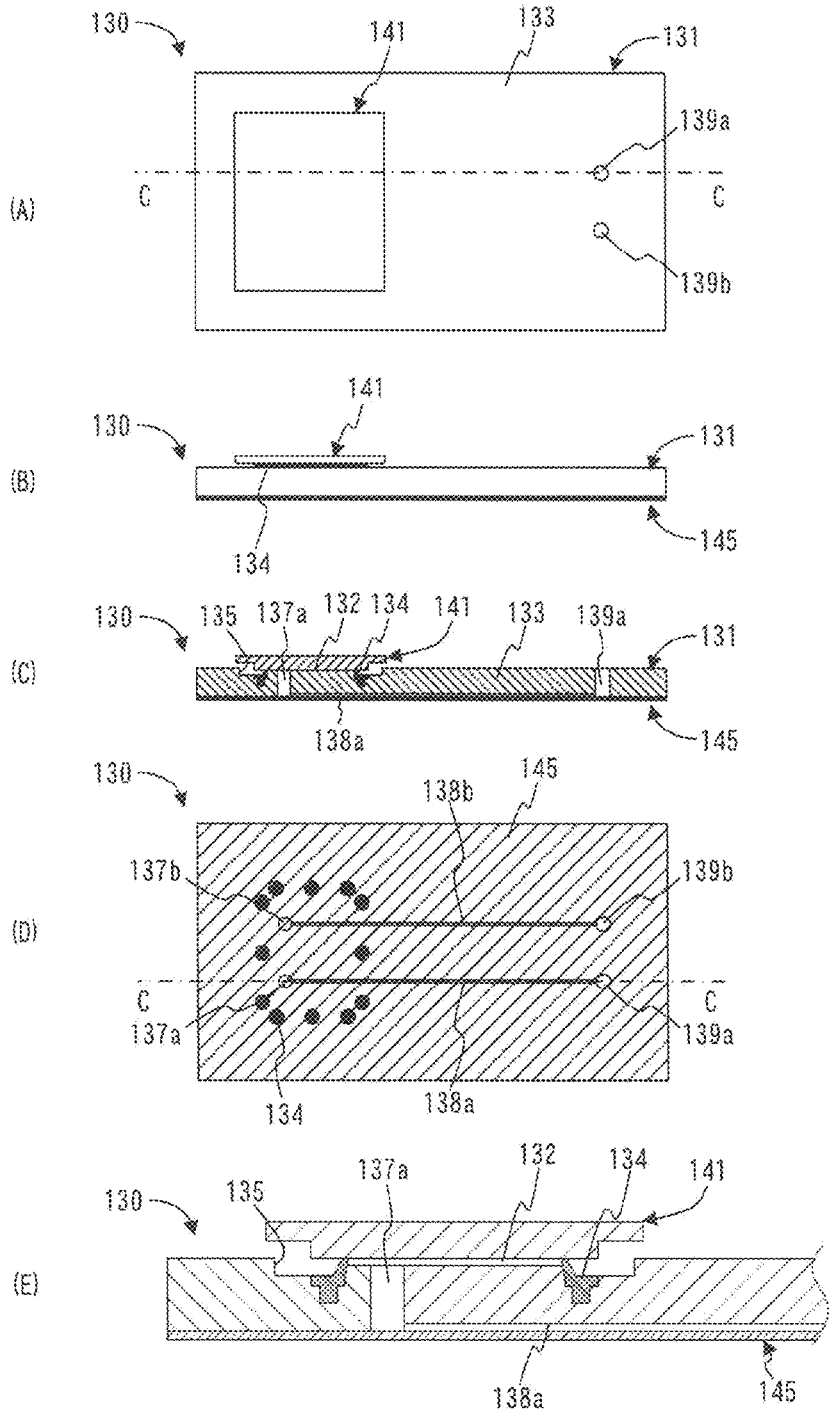
FIG. 14 (A) is a front view of a fluid device according to an embodiment of the present invention.

FIG. 13 illustrates respective components of a fluid device 130. FIG. 13 (A) is a front view of a fluid chip 131, FIG. 13 (C) is a rear view of the fluid chip 131, FIG. 13 (B) is a sectional view taken along B-B in FIG. 13 (A) and FIG. 13 (C), FIG. 13 (D) is a front view of a bonded member 141, FIG. 13 (E) is a sectional view taken along E-E in FIG. 13 (D), and FIG. 13 (F) is a front view of a rear surface side member 145. In addition, FIG. 14 illustrates the fluid device 130 with the combined respective components. FIG. 14 (A) is a front view of the fluid device 130, FIG. 14 (B) is a side view of the fluid device 130, FIG. 14 (D) is a rear view of the fluid device 130, FIG. 14 (C) is a sectional view taken along C-C in FIG. 14 (A) and FIG. 14 (D), and FIG. 14 (E) is an enlarged view of FIG. 14 (C).

In the fluid chip 131, a quadrangular recessed portion 135 is formed in the front of a base 133, a quadrangle-annular bonding member 134 is embedded in the recessed portion 135, and upper end portions of support post portions 136 of the base are exposed to four corners of the bonding member 134. A region surrounded by the bonding member 134 serves as a space of a reaction chamber 132, two internal through-holes 137*a* and 137*b* which penetrate the base 133 are formed in the reaction chamber 132, the internal through-holes 137*a* and 137*b* link with each one end of two linear grooves 138*a* and 138*b* respectively as flow passages on a rear surface side of the base 133. A height of the reaction chamber refers to a height from a top surface of the base 133 to the upper end portions of the support post portions 136 in a region surrounded by the bonding member 134, and in this embodiment, the reaction chamber was designed so as to have a height of 50±5 μm. The other ends of the grooves 138*a* and 138*b* link with two external through-holes 139*a* and 139*b* respectively which penetrate the base 133. A base top surface inside the space as the reaction chamber 132 surrounded by the bonding member 134 is higher than a base top surface outside the bonding member 134 in the recessed portion 135, but is slightly lower than the height of the upper end portions of the support post portions 136, and the reaction chamber 132 is configured so as to be a fine space when surrounded by the bonded member 141. The grooves 138*a* and 138*b* on a rear surface of the base serve as flow passages which are covered with the rear surface side member 145 to link the internal through-holes 137*a* and 137*b* with the external through-holes 139*a* and 139*b*. Note that, in a part of the structure, a valve structure (see FIG. 18) may be formed to make it possible to control an amount of the fluid fed to the reaction chamber 132 or an amount of the fluid discharged from the reaction chamber 132.

In this embodiment, the bonded member 141 serves as a detection element in which an image sensor 143 is mounted on a quadrangle substrate 142, in which a detection surface (lower surface in FIG. 13 (E)) of the image sensor 143 is arranged opposite to the reaction chamber 132 and bonded to the bonding member 134. The image sensor 143 is preferably in a substantially quadrangle shape which is larger than an outer edge of the bonding member 134 and smaller than the substrate 142. For the substrate 142, terminals for power supply to the image sensor 143, detection signal output, and the like are preferably provided on a peripheral edge portion of the image sensor 143 on a mounting surface of the image sensor 143. Note that, the surface opposite to a mounting surface of the substrate 142 is preferably flat, but may be uneven, and if the surface is uneven, the bonding is preferably carried out by the following steps illustrated in FIG. 16.

The rear surface side member 145 is a member for covering a groove formed on the rear surface of the base 133 so that the groove is used as a flow passage. Properties required for the rear surface side member 145 vary depending on a fluid for use and an experimental content of a fluid chip, and the rear surface side member 145 is selected considering impurity contamination to the fluid, barrier property from an external environment, heat resistance, adsorbability, strength, chemical resistance, transparency, light transmittance, intensity of autofluorescence, and the like. The rear surface side member 145 is preferably formed from a film-like plastic material, particularly preferably an engineering plastic film excellent in strength and heat resistance, but a glass, a metal, and the like can also be used. As the rear surface side member 145, polyethylene terephthalate, polycarbonate, polymethyl methacrylate, polyvinyl chloride, polypropylene, polyether, polyethylene, polystyrene, silicone resin, elastomer, and the like can be used, for example, but are not limited thereto. The rear surface side member 145 may have any size and shape as long as the rear surface side member 145 can cover the structure which needs to be covered on the rear surface, but may have a size and shape which cover the whole rear surface for flattening the rear surface.

As illustrated in FIG. 14, the fluid device 130 has a structure in which the bonded member 141 is bonded to the bonding member 134 on a front surface of the fluid chip 131, and the rea surface side member 145 is joined to a rear surface of the fluid chip 131. The joining of the rear surface side member 145 may be carried out before or after the bonding of the bonded member 141. However, when a high temperature and/or a high pressure is applied to the bonding of the rear surface side member 145, the image sensor of the bonded member 141 may be damaged, and therefore it is preferable that the rear surface side member 145 is first joined to the rear surface of the fluid chip 131 and then the bonded member 141 is bonded to the rear surface side member 145. When the bonding member 141 is also provided on the rear surface of the fluid chip 131, the rear surface side member 145 may be bonded to the fluid chip 131 with a bonding member, and when the bonding member is not provided, the rear surface side member 145 may be joined to the fluid chip 131 by means of thermocompression bonding, an adhesive, a double-sided adhesive film, or the like. Note that, when the bonding member is provided on the rear surface of the fluid chip, the bonding member only needs to be embedded in an intended area on the rear surface of the base, but it is preferable that the rear surface of the base is continuous with a circular rear surface side groove for embedding the bonding member formed on the rear surface of the base from the viewpoint of easiness of the manufacture.

In addition, for bonding the bonded member 141 to the bonding member 134 of the fluid chip 131, the bonded member 141 only needs to be brought into contact with the bonding member 134, but it is preferable to press the bonded member 141 against the bonding member 134, and it is more preferable to perform heating with a heating unit. Depends on the material and physical properties of the bonding member, the bonding may be carried out at a pressure of about 30 N while heating the bonding member to 120 to 150° C., for example. In a case that the bonded member 141 is pressed by being pushed against the bonding member 134 using a pressing unit or the like, when the pressure from the pressing unit is increased, the support post portions 136 of the fluid chip 131 may be deformed, or the support post portions 136 or the bonded member 141 may be broken. Particularly, in a microfluid chip, a pressing force concentrates on the support post portions and the support post portions 136 may be easily deformed or broken due to the restricted dimension of the support post portions themselves, as well as the narrow width of the bonding member, and elastic deformation of the bonding member. As a result, the reaction chamber may be ununiform in the height, or a plurality of fluid chips may vary in volumes of flow passages and reaction chambers, and therefore there has been a problem that it is difficult to perform a quantitative experiment under a uniform condition. Thus, an improved step or method for bonding the bonded member 141 will be explained below.

Figure 15:
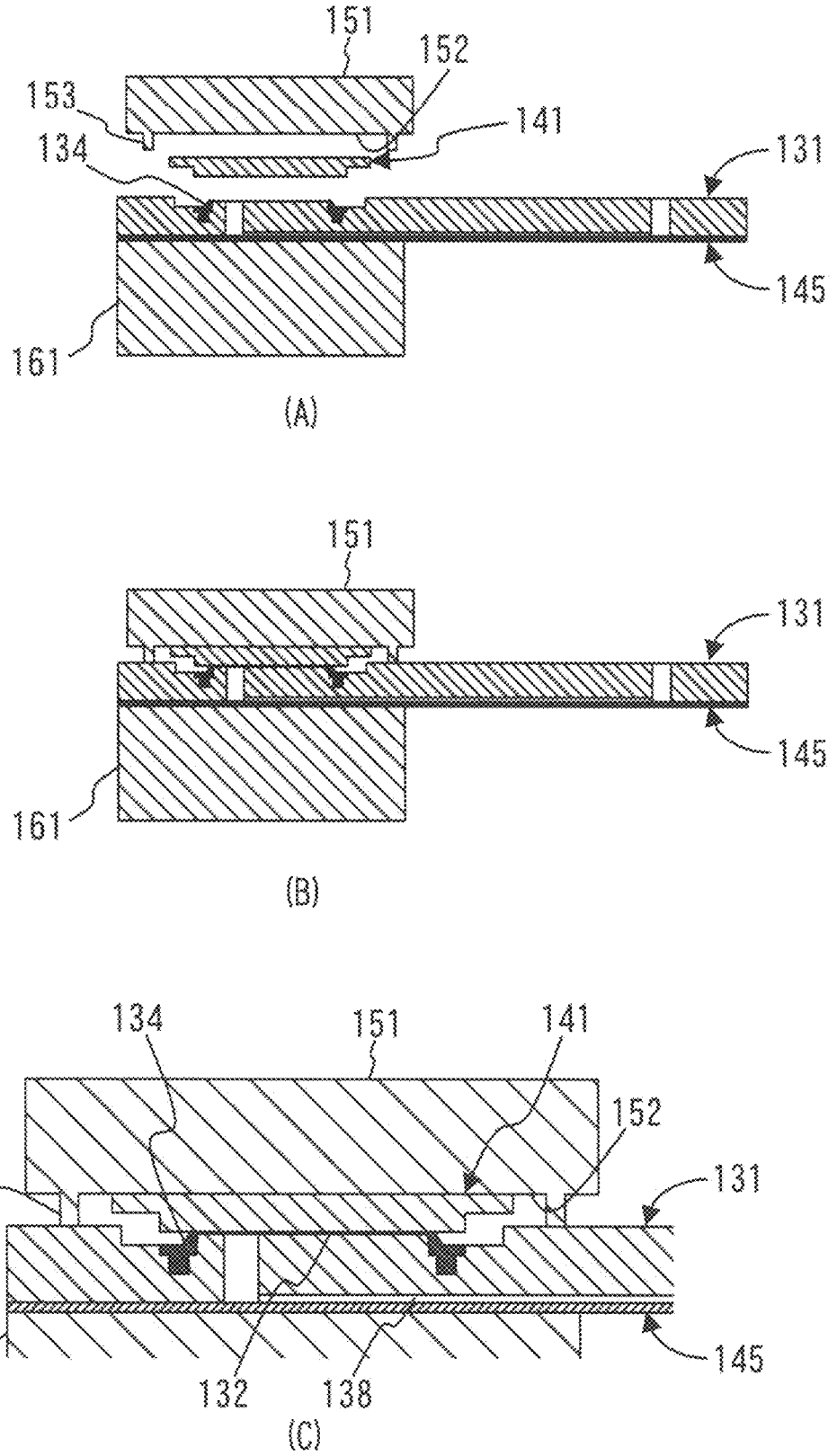
FIG. 15 is diagrams for explaining a step of bonding the bonding member with the bonded member according to an embodiment of the present invention.

FIG. 15 (A) illustrates a state before bonding, FIG. 15 (B) illustrates a state during pressing, and FIG. 15 (C) is a partially enlarged view of FIG. 15 (B). As illustrated in FIG. 15 (A), the fluid chip 131 (which has been previously joined with the rear surface side member in this embodiment, but need not be joined yet) is arranged on a heating unit 161, the bonded member 141 is arranged on the bonding member 134 of the fluid chip 131 while positioning the bonded member 141 so as to overlap with the bonding member 134, and a pressing unit 151 is arranged on the bonded member 141. The pressing unit 151 is configured to be movable in the vertical direction of the figure, and can apply a load downward through a pressing surface 152. The heating unit 161 has a heat source such as a heater inside, and can heat a member arranged on the heating unit 161. Note that, when no heat is used for bonding, a mounting table for mounting the fluid chip may be arranged instead of the heating unit 161.

In this embodiment, stoppers for maintaining a constant distance between the pressing surface 152 of the pressing unit 151 and the top surface of the fluid chip 131 are characteristically provided at a position where the bonded member is not arranged. In FIG. 15, as the stoppers, a plurality of leg portions 153 project at a position where the bonded member is not arranged on the pressing surface 152 of the pressing unit 151. A height of the leg portions 153 is substantially equivalent to the distance from the upper surface of the bonded member 141 to the upper surface of the fluid chip 131 at a position where the leg portions 153 project in a state that the bonded member 141 is bonded to the bonding member 134 of the fluid chip 131 (state of the fluid device 30). Preferably, the height of the leg portions 153 is adjustable so that another fluid chip or bonded member having a different thickness can also be used. For the purpose of adjusting the height, e.g. a structure in which screw holes are formed on the pressing surface 152 of the pressing unit 151 and the leg portions 153 are screwed and attached into the screw holes is constructed, in which shim rings or the like having a predetermined thickness may be interposed between the pressing surface 152 and the leg portions 153 to adjust the height of the leg portions 153 by the thickness of the shim rings or the like. In addition, it is preferable that a plurality of leg portions 153 are provided and uniformly arranged to make the horizontal state of the pressing surface so that a pressing force can be uniformly applied to the bonded member, and thus the bonding can be carried out while the height of the reaction chamber is uniform.

In addition, as illustrated in FIG. 15 (B), the bonded member 141 is arranged on the bonding member 134 of the fluid chip 131 arranged on the heating unit 161, and the bonded member 141 is pressed by lowering the pressing unit 151 while heating with the heating unit 161, to join the bonded member 141 to the bonding member 134. In this embodiment, since the bonded member 141 is pressed by the pressing unit 151 in which the leg portions 153 project from the pressing surface 152, the leg portions 153 butt against the upper surface of the fluid chip 131 even when applying a high pressing force, and prevents the pressing surface 152 from moving downward, so that a certain pressure or higher can be prevented from being applied to the bonded member 141, and breakage or the like of the support post portions and the bonded member can be prevented. Note that, during the pressing, the bonded member 141 is not necessarily pressed until the leg portions 153 come into contact with the top surface of the fluid chip 131, and such a pressing force that the leg portions 153 do not come into contact with the top surface of the fluid chip 131 is also allowed as long as a sufficient bonding can be obtained. Although the configuration that the leg portions as stoppers projecting from the pressing unit were butted against the upper surface of the fluid chip was adopted in FIG. 15, a configuration that the leg portions are butted against another member e.g. the top surface of the heating unit and another member may also be adopted. Furthermore, instead of providing the leg portions on the pressing unit, another member independent of the pressing unit may be interposed between the upper surface of the fluid chip and the pressing unit, or alternatively a pillar portion as a stopper for preventing the pressing unit from moving downward, or the like may be provided on the mounting table for mounting the fluid chip (heating unit in FIG. 15). In such a way, installation of a stopper having a predetermined height makes it possible to prevent the downward movement of the pressing surface, application of a certain pressure or higher to the bonded member, and breakage or the like of the support post portions and the bonded member.

Figure 16:
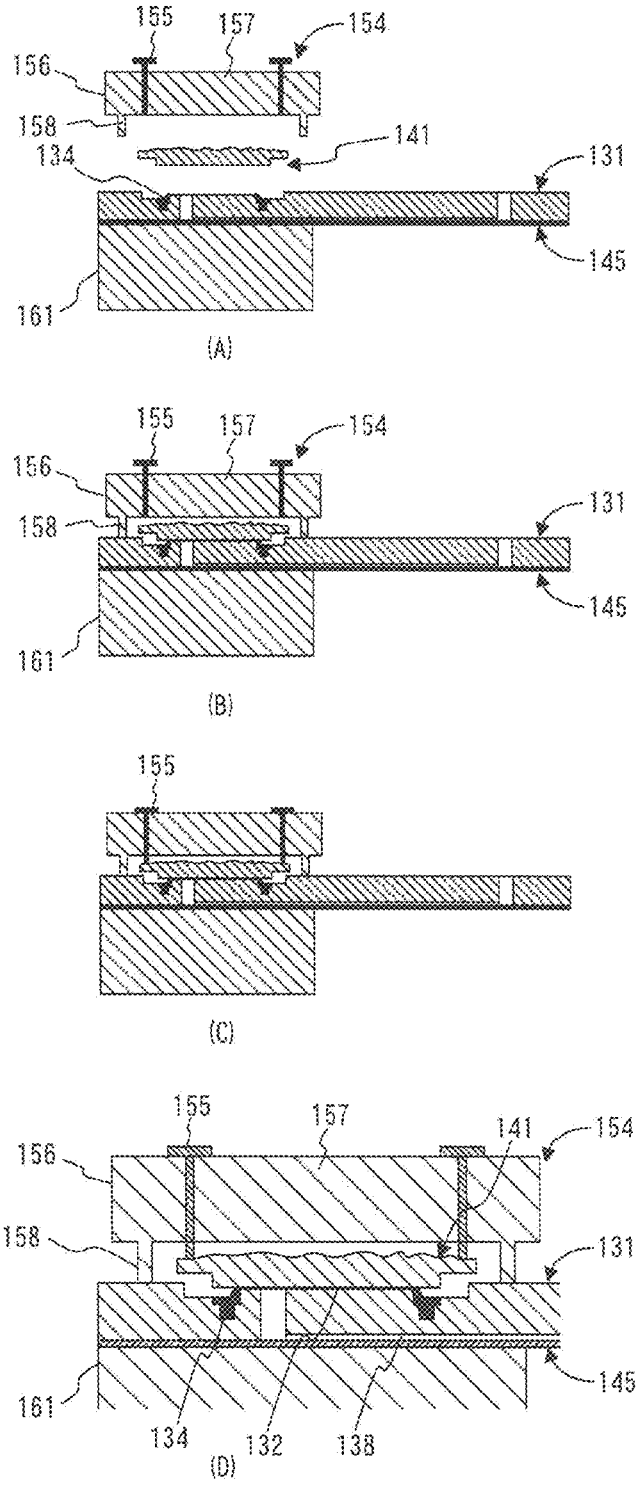
FIG. 16 is diagrams for explaining a step of bonding the bonding member with the bonded member according to another embodiment of the present invention.

FIG. 16 illustrates another embodiment, FIG. 16 (A) illustrates a state before bonding, FIG. 16 (B) illustrates a state before pressing, FIG. 16 (C) illustrates a state during pressing, and FIG. 16 (D) is a partially enlarged view of FIG. 16 (C). As illustrated in FIG. 16 (A), the fluid chip 131 (which has been previously joined with the rear surface side member in this embodiment, but need not be joined yet) is arranged on the heating unit 161, the bonded member 141 is aligned and arranged on the bonding member 134 so that the bonded member 141 overlaps with the bonding member 134, and a pressing unit 154 is arranged on the bonded member 141. This embodiment has a feature that the pressing unit 154 has pressing members 155, and a supporting member 156 configured to support the pressing member 155 so that the pressing member 155 can vertically move, and downward movement of the pressing members 155 is restricted to within a certain range. The pressing members 155 come into contact with the upper surface of the bonded member 141 on the lower end and apply a downward pressure to the bonded member 141. The supporting member 156 supports the pressing members 155 at a predetermined position above the bonded member 141. Installation of the plurality of pressing members is preferable because a pressing force can be more uniformly applied to the bonded member, and it is preferable that the plurality of pressing members are uniformly arranged. To restrict the downward movement of the pressing members 155 to within a certain range, a part of the supporting member 156 may be used, or another member may be used. In addition, a mechanism for pressing the pressing members 155 downward may be provided on the pressing members 155 themselves or on the supporting member 156, or may be provided separately. The supporting member 156 itself may be provided movably with respect to the heating unit 161, or may be fixed. In FIG. 16, the supporting member 156 has a top plate 157 and pillar portions 158, and the supporting member 156 itself can vertically move. Furthermore, the pressing members 155 are inserted into through-holes formed on the top plate 157 so as to be movable with respect to the supporting member.

As illustrated in FIG. 16 (B), the height of the pillar portions 158 of the supporting member 156 is preferably set such that the lower surface of the top plate 157 is higher than the upper surface of the bonded member 141 in a state that the pillar portions 158 are in contact with the upper surface of the fluid chip 131, but a part of the lower surface of the top plate 157 may be in contact with a part of the upper surface of the bonded member 141. Each pressing member 155 has a pin having a shape corresponding to the shape of the through-hole, and when a width of an upper end of the pin is larger than a width of the through-hole, the downward movement of the pressing members 155 can be restricted to within a range until wide upper ends of the pressing members 155 come into contact with the upper surface of the supporting member 156. A range of the downward movement is set so that, at a lowest point of the movement, a lower end of the pin presses the upper surface of the bonded member 141 with an appropriate pressure. In addition, the movement range is preferably variable. For example, a position of the wide part on the upper end of the pin can be changed in a vertical direction of the pin, or alternatively a shim ring or the like having a predetermined thickness may be interposed between the wide part on the upper end of the pin and the upper surface of the supporting member to adjust the height by a thickness of the shim ring or the like.

As illustrated in FIG. 16 (C), in a state that the supporting member 156 is mounted on the fluid chip 131, the pressing members 155 are moved downward with respect to the supporting member 156, so that the lower ends of the pins of the pressing members 155 are pressed against the upper surface of the bonded member 141, and the bonded member 141 can be pressed by the pressing members 155. In this pressing state, a length of the pins projecting from the lower surface of the supporting member 156 is within at most a range until the wide part on the upper end of the pin butts against the supporting member. Also in this case, since the pressing force applied to the bonded member 141 is adjusted so as not to be excessive, it is possible to prevent application of a pressure equal to or higher than a certain level to the bonded member 141, and breakage of the support post portions and the bonded member, or the like. In addition, as illustrated in FIG. 16 (D), even when the bonded member 141 has an uneven upper surface, the bonded member 141 can be pressed while maintaining the horizontality of the bonded member 141 because of adopting the pressing members 155 having the pin-like lower ends. Thereby, the bonding can be carried out while maintaining the uniform height of the reaction chamber, and therefore the pin-like pressing members 155 are preferable. Furthermore, when bonding the bonded member, it is sufficient that only the pressing members are positioned and a pressing force for bonding is applied only to the pressing members, and as in Embodiment 1, the pressing can be achieved with a relatively compact device compared to a configuration in which pressing is carried out by aligning and downwardly moving the whole pressing unit. In addition, since the pressing force of the plurality of pressing members can be adjusted within a movable range of them, the pressing can be carried out while maintaining the horizontality of the bonded member. Even if support post portions of the fluid chip cannot be formed, the bonding member can be joined to the bonded member such that the reaction chamber have a uniform height. Although FIG. 16 illustrates the structure in which the pillar portions 158 of the supporting member 156 are mounted on the upper surface of the fluid chip, the present invention is not limited to this structure. For example, the supporting member 156 may be mounted on or fixed to the heating unit 161 in the outer region of the fluid chip, or alternatively the supporting member 156 may be fixed above the fluid chip by another member without providing the pillar portions 158. Note that, when heat is not used for bonding, a mounting table for mounting the fluid chip may be arranged instead of the heating unit 161.

Figure 17:
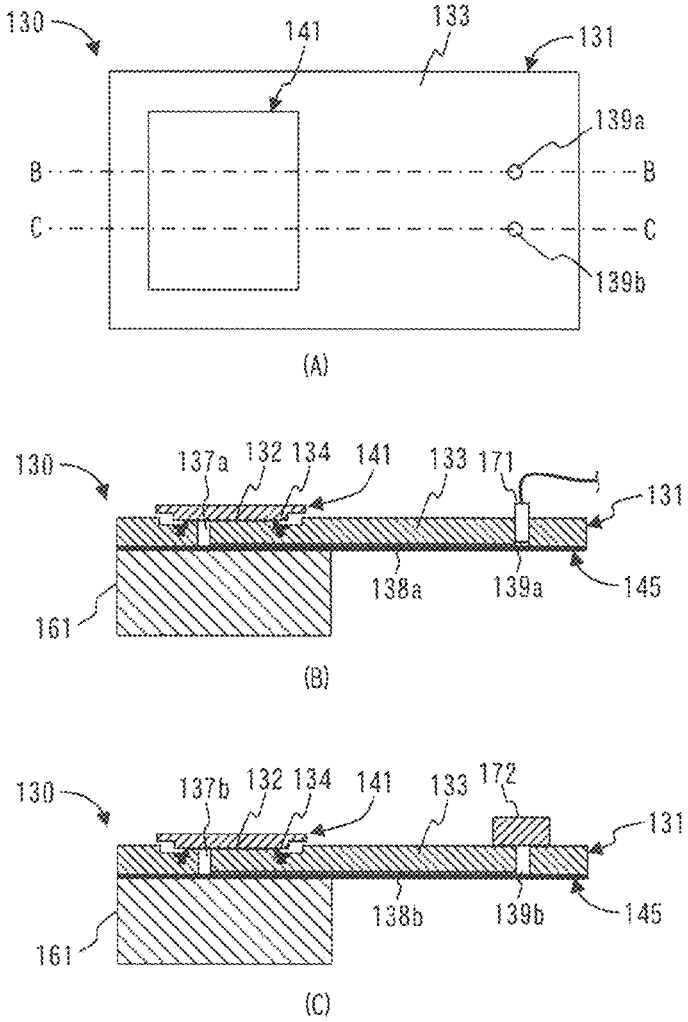
FIG. 17 is diagrams for explaining a step of bonding the bonding member with the bonded member according to another embodiment of the present invention.

FIG. 17 illustrates still another embodiment. FIG. 17 (A) is a front view of the fluid device, FIGS. 17 (B) and 17 (C) are B-B and C-C cross section respectively in FIG. 17 (A) in a bonding step. This embodiment relates to a method for joining the bonding member 134 with the bonded member 141 without mechanically pressing the bonded member 141 from above, and the method has a feature that an inside of a flow passage (reaction chamber) surrounded by the bonded member 141 and the bonding member 134 is depressurized so that the bonding member 134 and the bonded member 141 are bonded by an outside air pressure. The fluid device 130 in FIG. 17 (A) has the same structure as in FIG. 13 and FIG. 14, the two internal through-holes 137*a* and 137*b* are formed in the reaction chamber 132, and the internal through-holes 137*a* and 137*b* link with the two external through-holes 139*a* and 139*b* respectively through the two linear grooves 138*a* and 138*b* respectively on the rear side of the base 133. In FIG. 17, the fluid chip 131 joined with the rear surface side member is arranged on the heating unit 161, a suction port 171 of a suction apparatus is connected to one of the external through-holes 139*a*, and the other external through-hole 139*b* is closed with a plug 172. Then, while heating the heating unit 161, the suction apparatus is activated to suck air inside the reaction chamber 132 from the suction port 171, and the bonding member 134 and the bonded member 141 are joined by a pressure difference between the inside and the outside.

As described above, in this embodiment, the bonded member can be bonded to the bonding member without mechanically pressing the bonded member. In a case that the bonded member is relatively easily broken, or in a case that the bonded member is not suitable for mechanical pressing due to a shape of the bonded member, the method according to this embodiment is useful. In addition, since the bonding is carried out by the pressure difference, the horizontality of the bonded member can be maintained, the bonding can be carried out while maintaining the uniform height of the reaction chamber, and therefore the bonding by the pressure difference is preferable. The suction apparatus is not particularly limited, and e.g. a suction pump or the like can be used. Although the suction port 171 only needs to be connected to at least one of the external through-holes, the suction port 171 may be connected to both the external through-holes to suck air from both the flow passages. In a case that the fluid device has a valve structure using the rear surface side member in the way of the flow passage, when air is sucked through the valve structure, heat from the heating unit is also transmitted to the valve structure, and thereby problems such as deformation of the valve structure may be caused. Thus, it is preferable that the external through-hole having the valve structure in the way to the reaction chamber is closed by the plug 172, and air is sucked from the other external through-hole. However, even in the case of providing a valve structure, when joining the bonded member without using the heating unit, the suction may be carried out through the valve structure. Additionally, in the case that the bonded member is bonded to the bonding member before joining the rear surface side member to the fluid chip 131, the suction port may be connected to one or both of the openings on the rear side of the internal through-holes 137*a* and 137*b* for suction. The plug 172 only needs to be able to seal the pathway, and is not particularly limited, but is preferably temporarily closed with an appropriate resin film or the like. Note that, such a suction as in this embodiment may be combined with such a mechanical pressing as in the other embodiment for bonding.

Figure 18:
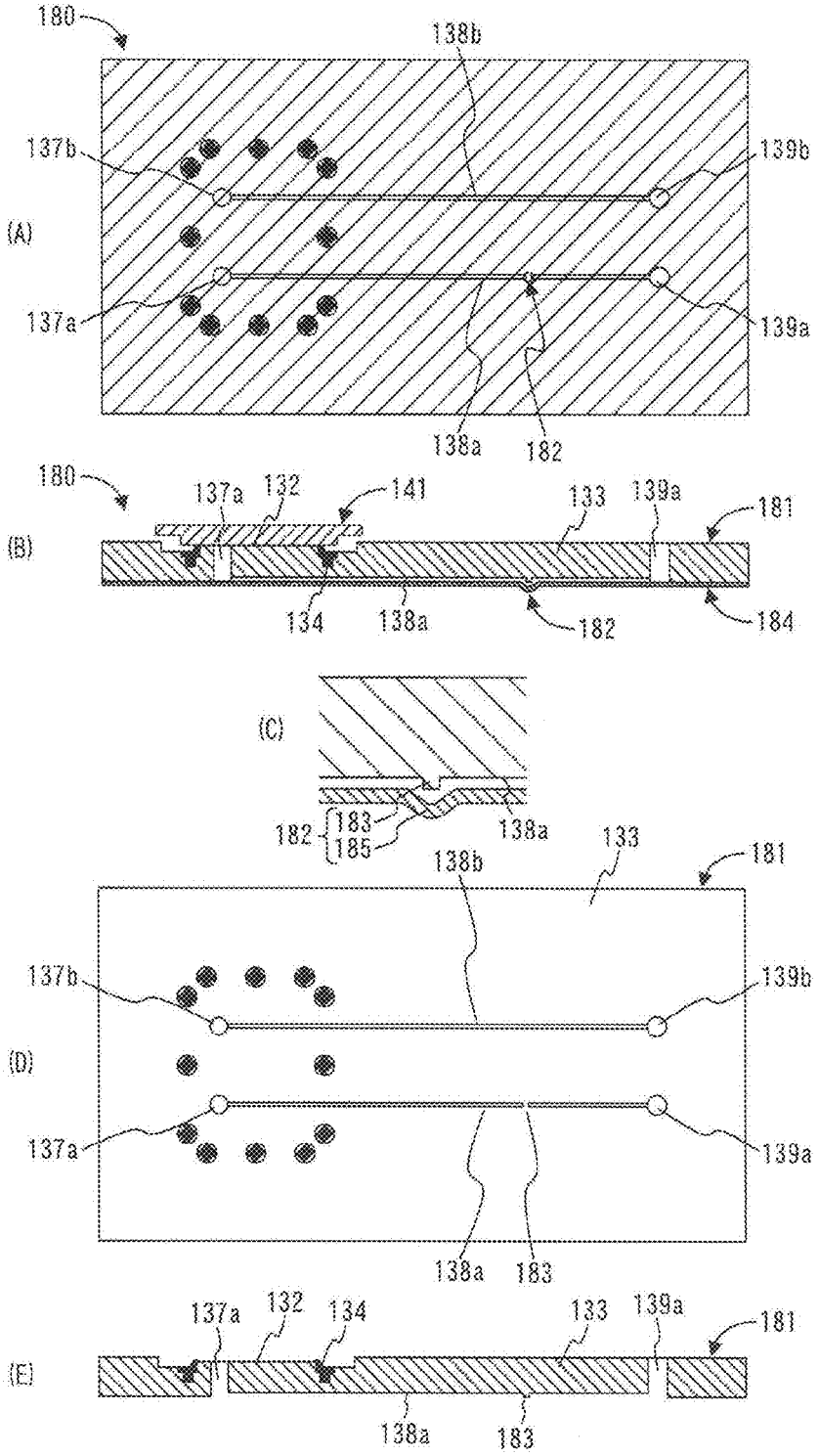
FIG. 18 (A) is a rear view of a fluid device having a valve structure.

FIG. 18 illustrates an example of the fluid device 180 having a valve structure 182, and a fluid chip 181 of the fluid device 180. FIG. 18 (A) and FIG. 18 (B) are a rear view and a sectional view respectively of the fluid device 180. FIG. 18 (C) is an enlarged view of the valve structure 182 in FIG. 18 (B). FIG. 18 (D) and FIG. 18 (E) are a rear view and a sectional view respectively of the fluid chip 181. FIG. 18 has a structure similar to that in FIG. 13 and FIG. 14 excluding a part of the valve structure 182, and the structure will be explained using the same reference numerals as in FIG. 13 and FIG. 14. The valve structure 182 in FIG. 18 is a structure in which a part of the groove 138*b* on the rear surface of the base 133 is interrupted by an interruption portion 183, a formed portion 185 of a rear surface side member 184, which is formed into a dome shape, is arranged on the interruption portion 183, so that the flow passage interrupted by the interruption portion 183 is continued by a dome-like space of the formed portion 185. When the formed portion 185 is dome-shaped, the valve is in an open state, the flow passage can be thinned by crushing and deforming the formed portion, to decrease a flow rate. When the flow passage is closed by the formed portion, the valve can be brought into a closed state. Note that, the shape of the molded portion of the rear surface side member 184 is not limited to the dome shape as long as the formed portion has a space where the fluid flows over the interruption portion 183. The fluid device 180 having such a formed portion 185 has had a problem that when the fluid device is heated during bonding the bonded member 141 to the bonding member 134, the shape of the formed portion is deformed by the heat.

Figure 19:
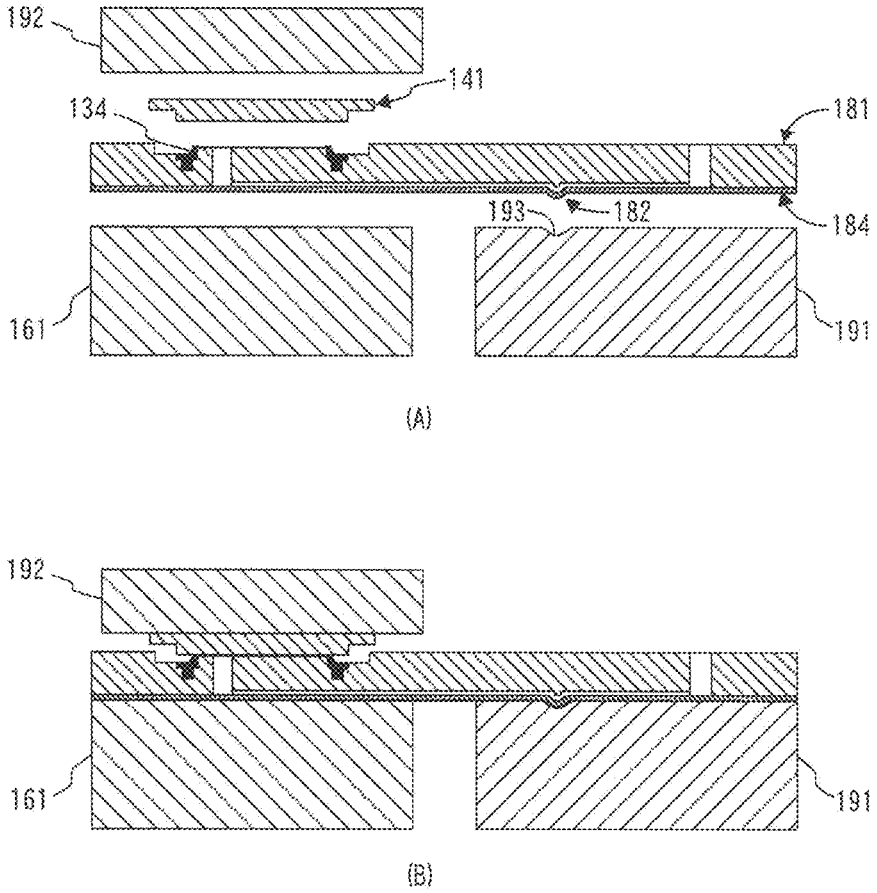
FIG. 19 is diagrams for explaining a step of bonding the bonding member and the bonded member according to another embodiment of the present invention.

FIG. 19 relates to an embodiment in which the bonding member 134 and the bonded member 141 are joined in the fluid device having the formed portion 185 formed into a special shape on the rear surface side member 184 like the valve structure. FIG. 19 (A) illustrates a state before bonding, and FIG. 19 (B) illustrates a state during pressing. In this embodiment, when heating the bonding member 134 and the bonded member 141, a cooling unit 191 for suppressing heat transmission to the formed portion of the rear surface side member and preventing deformation is characteristically arranged in the vicinity of the formed portion 185. As illustrated in FIG. 19 (A), the bonding member 134 of the fluid chip 181 joined with the rear surface side member is arranged on the heating unit 161, the valve structure 182 is arranged on the cooling unit 191, the bonded member 141 is aligned and arranged on the bonding member 134 so that the bonded member 141 overlaps with the bonding member 134, and a pressing unit 192 is arranged on the bonded member 141. The cooling unit 191 is intended to suppress heat transmission to the formed portion 185, and may be a member having a high thermal conductivity, such as metal, or may have a structure in which a refrigerant is circulated inside to maintain a low temperature. It is preferable that the cooling unit 191 is away from the heating unit 161 or thermally separated from the heating unit 161 by interposing a heat insulator between them. In FIG. 19, the cooling unit 191 is arranged below the fluid chip 181, but the cooling unit 191 may be arranged above the fluid chip 181 or arranged both below and above the fluid chip 181. In addition, it is preferable that a depression 193 corresponding to the shape of the formed portion 185 of the rear surface side member is formed on the top surface of the cooling unit 191, and the formed portion is arranged in the depression 193, because the bonding step can be performed without deforming the formed portion by the cooling unit. In this embodiment, the pressing unit 192 is not particularly limited, and may be the unit which presses the bonded member 141 on a flat surface as illustrated in FIG. 19, or may be the pressing units as illustrated in FIG. 15 and FIG. 16. By arranging the cooling unit 191 in this manner, heat from the heating unit 161 is dissipated by the cooling unit 191, heat transmission to the formed portion 185 can be suppressed, and deformation of the formed portion 185 can be prevented, even if the bonded member 141 is bonded to the bonding member 134 by lowering the pressing unit 192 and pressing the bonded member 141 while heating with the heating unit 161.

REFERENCE NUMERALS

1 Fluid chip
2 Flow passage
3 Base
4 Bonding member
31 Top surface
32 Support post portion
35 Groove
41 Exposed region
41*a* Upper end surface
42 Buried region
43 Wall portion
44 Corner portion

The invention claimed is:

1. A fluid chip in which a flow passage is formed, wherein the fluid chip has:

a base having a top surface and a rear surface, the top surface constituting at least a part of a bottom surface of the flow passage; and a bonding member formed from an elastomer resin and having an upper end surface and a buried region, the upper end surface disposed outwardly from the top surface and extending away from the rear surface of the base, and the buried region disposed in a groove in the base and disposed inwardly from the top surface and extending toward the rear surface of the base, the base has support post portions projecting outwardly from the top surface and demarcating a height of side surfaces of the flow passage, and the support post portions of the base are embedded in the bonding member.

2. The fluid chip according to claim 1, wherein the bonding member has a self-adhesiveness property.

3. The fluid chip according to claim 1, wherein the upper end surface of the bonding member is coplanar with or extending outwardly from upper end surfaces of the support post portions of the base.

4. The fluid chip according to claim 1, wherein the bonding member is mechanically fixed to the base.

5. The fluid chip according to claim 1, wherein the groove of the base is a continuous or discrete groove disposed along the side surfaces of the flow passage, and the bonding member is joined with the base in the groove of the base.

6. The fluid chip according to claim 5, wherein at least a portion of the groove extends to the rear surface of the base.

7. The fluid chip according to claim 5, wherein the groove of the base has a constricted portion having a width narrowing in a depth direction of the groove, and the bonding member has a shape adapted to the constricted portion.

8. The fluid chip according to claim 5, wherein the support post portions are arranged inside the groove of the base.

9. The fluid chip according to claim 1, wherein the bonding member constitutes at least a part of the side surfaces of the flow passage.

10. The fluid chip according to claim 9, wherein the whole bottom surface of the flow passage is composed of the top surface of the base, and the whole side surfaces of the flow passage are composed of the bonding member.

11. The fluid chip according to claim 1, wherein the support post portions are discretely arranged along the side surfaces of the flow passage.

12. The fluid chip according to claim 11, wherein the support post portions are provided on ends or corners of the side surfaces of the flow passage.

13. The fluid chip according to claim 1, wherein the support post portions are not exposed to the flow passage.

14. The fluid chip according to claim 1, wherein the support post portions comprise the side surfaces of the flow passage.

15. A fluid device having:

the fluid chip according to claim 1; and a bonded member which is bonded to the upper end surface of the bonding member.

16. The fluid device according to claim 15, wherein the bonding member has a self-adhesiveness property, and the bonded member is bonded to the upper end surface via the self-adhesiveness of the bonding member.

17. The fluid device according to claim 15, wherein the bonded member is a fluid control element, a peripheral circuit, a detection element, or a top plate of the flow passage.

18. A fluid chip manufacturing method, including the steps of:

molding a base with a first material by using a first mold, the base having a top surface constituting a bottom surface of a flow passage and support post portions projecting to higher than the top surface;

arranging the base in a second mold; and molding a bonding member with an elastomer resin by using the second mold and the base, such that the support post portions of the base are embedded in the bonding member.

19. The fluid chip manufacturing method according to claim 18, wherein the base has a groove provided along side surfaces of the flow passage and penetrating the base, and the elastomer resin is fed from a rear surface side of the base through the groove.

20. A fluid device manufacturing method, wherein a bonded member is brought into contact with the upper end surface of the bonding member in the fluid chip according to claim 1, thereby bonding the bonded member to the fluid chip.

* * * * *